US007317431B2

(12) United States Patent
Suzuki et al.

(10) Patent No.: US 7,317,431 B2
(45) Date of Patent: Jan. 8, 2008

(54) DISPLAY PANEL DRIVING METHOD

(75) Inventors: Masahiro Suzuki, Yamanashi-ken (JP); Jun Kamiyamaguchi, Yamanashi-ken (JP); Tetsuya Shigeta, Yamanashi-ken (JP); Hirofumi Honda, Tokyo (JP); Tetsuro Nagakubo, Tokyo (JP)

(73) Assignee: Pioneer Corporation, Tokyo (JP)

( * ) Notice: Subject to any disclaimer, the term of this patent is extended or adjusted under 35 U.S.C. 154(b) by 720 days.

(21) Appl. No.: 10/882,152

(22) Filed: Jul. 1, 2004

(65) Prior Publication Data

US 2005/0057452 A1 Mar. 17, 2005

(30) Foreign Application Priority Data

Jul. 2, 2003 (JP) ..... 2003-190284

(51) Int. Cl.
*G09G 3/28* (2006.01)

(52) U.S. Cl. ..... 345/63; 345/60; 345/61; 345/62; 345/37

(58) Field of Classification Search ..... 345/63, 345/60, 61, 62, 37
See application file for complete search history.

(56) References Cited

U.S. PATENT DOCUMENTS 6,747,669 B1 * 6/2004 Yamaguchi et al. ..... 345/690
6,836,263 B2 * 12/2004 Naka et al. ..... 345/60
7,057,773 B2 * 6/2006 Ilbery ..... 358/3.05

FOREIGN PATENT DOCUMENTS

JP 2000-227778 A 8/2000

* cited by examiner

*Primary Examiner*—Richard Hjerpe
*Assistant Examiner*—Leonid Shapiro
(74) *Attorney, Agent, or Firm*—Sughrue Mion, PLLC

(57) ABSTRACT

A method of grayscale-driving a display panel in accordance with pixel data derived from a video signal. The display panel includes a plurality of display lines, with a plurality of pixel cells serving as pixels being arranged on each display line. A display period of a single field of the video signal is divided into a plurality of subfields. The method includes dividing one subfield into M lower subfields. M is an integer greater than one. M groups of display lines are prepared by sequentially taking every M display lines from the display lines. First to Mth address steps are performed in the M lower subfields respectively and sequentially. Each address step sets the pixel cells belonging to the display lines of the display line group concerned, to a drive mode determined by the pixel data. A first light emission step is performed to cause the pixel cells whose drive mode is a lit mode, to emit light directly before or after the address step concerned. Another subfield is divided into N lower subfields. N is smaller than M. N groups of L continuos address steps are prepared from the first to Mth address steps. L is an integer greater than one. The N groups of L continuous address steps are performed in the N lower subfields respectively and sequentially. A second light emission step is performed to cause the pixel cells whose drive mode is the lit mode, to emit light directly before or after the address step group concerned.

4 Claims, 32 Drawing Sheets

FIG. 2

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION

FIG. 5

| CONVERSION TABLE | | | | |
|---|---|---|---|---|
| MD | GD | | | |
| | 0 | 1 | 2 | 3 |
| 000 | 1 | 0 | 0 | 0 |
| 001 | 0 | 1 | 0 | 0 |
| 010 | 0 | 0 | 1 | 0 |
| 011 | 0 | 0 | 0 | 1 |
| 100 | 0 | 0 | 0 | 0 |

ONE FIELD
SF0
SF1
SF2
SF3
SF4

FIRST FIELD

SECOND FIELD

THIRD FIELD

FOURTH FIELD

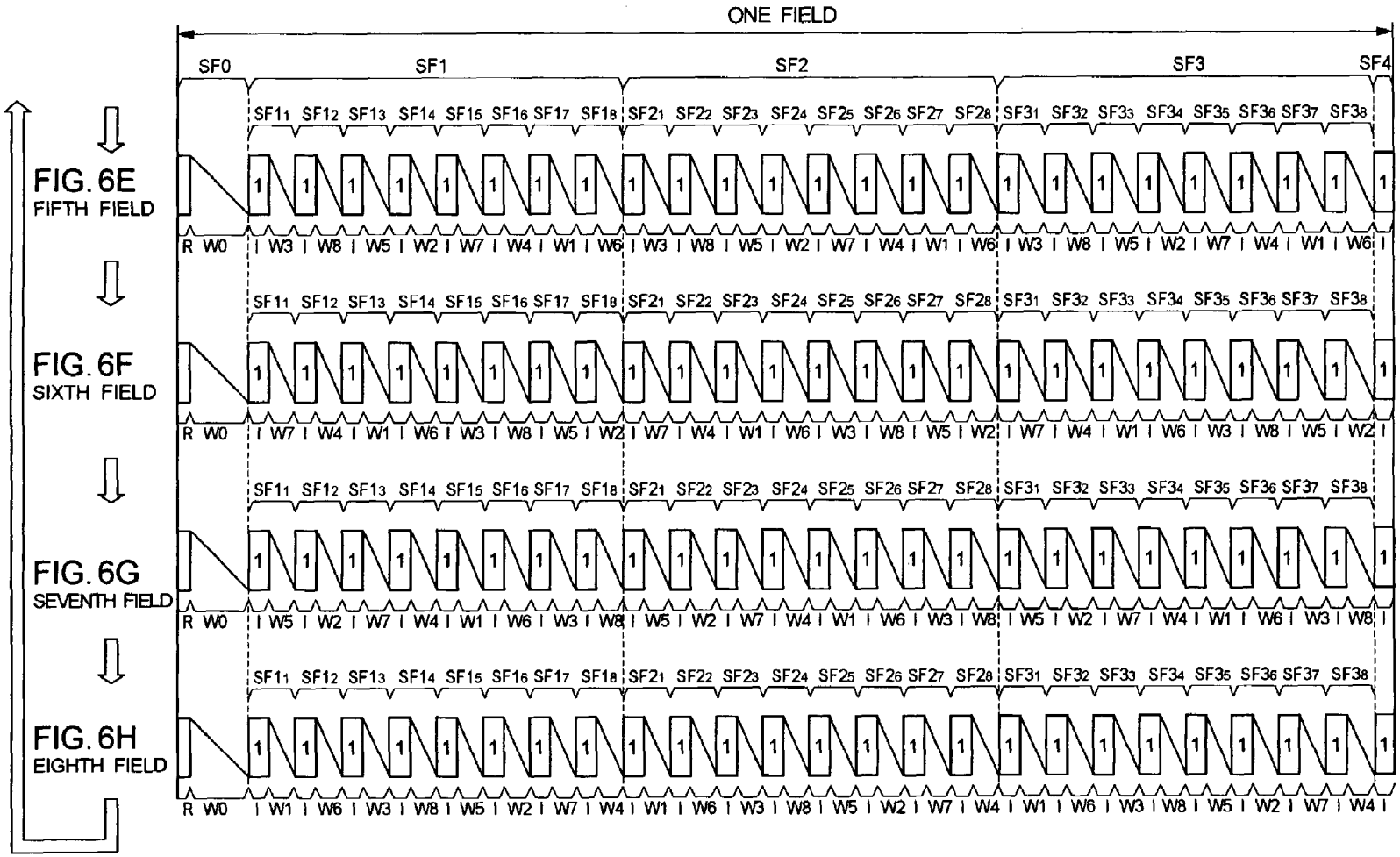
FIG. 6E FIFTH FIELD
FIG. 6F SIXTH FIELD
FIG. 6G SEVENTH FIELD
FIG. 6H EIGHTH FIELD

FIG.7

| | PIXEL DRIVE DATA GD 0 1 2 3 | DISPLAY LINE | SF 0 | SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|---|
| | | | | LIGHT EMISSION PATTERN | | | | | | | | | | | | | | | | | | | | | | | | | |
| FIRST GRAYSCALE DRIVING | 1 0 0 0 | 8N-7 | ● | | | | | | | | | | | | | | | | | | | | | | | | | | 0 |
| | | 8N-6 | ● | | | | | | | | | | | | | | | | | | | | | | | | | | 0 |
| | | 8N-5 | ● | | | | | | | | | | | | | | | | | | | | | | | | | | 0 |
| | | 8N-4 | ● | | | | | | | | | | | | | | | | | | | | | | | | | | 0 |
| | | 8N-3 | ● | | | | | | | | | | | | | | | | | | | | | | | | | | 0 |
| | | 8N-2 | ● | | | | | | | | | | | | | | | | | | | | | | | | | | 0 |
| | | 8N-1 | ● | | | | | | | | | | | | | | | | | | | | | | | | | | 0 |
| | | 8N | ● | | | | | | | | | | | | | | | | | | | | | | | | | | 0 |
| SECOND GRAYSCALE DRIVING | 0 1 0 0 | 8N-7 | | ○ | ○ | ○ | ○ | ○ | ○ | ○ | ⊙ | | | | | | | | | | | | | | | | | | 8 |
| | | 8N-6 | | ○ | ○ | ○ | ○ | ⊙ | | | | | | | | | | | | | | | | | | | | | 5 |
| | | 8N-5 | | ○ | ⊙ | | | | | | | | | | | | | | | | | | | | | | | | 2 |
| | | 8N-4 | | ○ | ○ | ○ | ○ | ○ | ○ | ⊙ | | | | | | | | | | | | | | | | | | | 7 |
| | | 8N-3 | | ○ | ○ | ○ | ⊙ | | | | | | | | | | | | | | | | | | | | | | 4 |
| | | 8N-2 | | ⊙ | | | | | | | | | | | | | | | | | | | | | | | | | 1 |
| | | 8N-1 | | ○ | ○ | ○ | ○ | ○ | ⊙ | | | | | | | | | | | | | | | | | | | | 6 |
| | | 8N | | ○ | ○ | ⊙ | | | | | | | | | | | | | | | | | | | | | | | 3 |
| THIRD GRAYSCALE DRIVING | 0 0 1 0 | 8N-7 | | ○ | ○ | ○ | ○ | ○ | ○ | ○ | ○ | ○ | ○ | ○ | ○ | ○ | ○ | ○ | ⊙ | | | | | | | | | | 16 |
| | | 8N-6 | | ○ | ○ | ○ | ○ | ○ | ○ | ○ | ○ | ○ | ○ | ○ | ○ | ⊙ | | | | | | | | | | | | | 13 |
| | | 8N-5 | | ○ | ○ | ○ | ○ | ○ | ○ | ○ | ○ | ○ | ⊙ | | | | | | | | | | | | | | | | 10 |
| | | 8N-4 | | ○ | ○ | ○ | ○ | ○ | ○ | ○ | ○ | ○ | ○ | ○ | ○ | ○ | ○ | ⊙ | | | | | | | | | | | 15 |
| | | 8N-3 | | ○ | ○ | ○ | ○ | ○ | ○ | ○ | ○ | ○ | ○ | ○ | ⊙ | | | | | | | | | | | | | | 12 |
| | | 8N-2 | | ○ | ○ | ○ | ○ | ○ | ○ | ○ | ○ | ⊙ | | | | | | | | | | | | | | | | | 9 |
| | | 8N-1 | | ○ | ○ | ○ | ○ | ○ | ○ | ○ | ○ | ○ | ○ | ○ | ○ | ○ | ⊙ | | | | | | | | | | | | 14 |
| | | 8N | | ○ | ○ | ○ | ○ | ○ | ○ | ○ | ○ | ○ | ○ | ⊙ | | | | | | | | | | | | | | | 11 |
| FOURTH GRAYSCALE DRIVING | 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | | 8N-5 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | | 8N-3 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | | 8N-2 | | ○ | ○ | ○ | ○ | ○ | ○ | ○ | ○ | ○ | ○ | ○ | ○ | ○ | ○ | ○ | ○ | ⊙ | | | | | | | | | 17 |
| | | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | | 8N | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| FIFTH GRAYSCALE DRIVING | 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.8

| PIXEL DRIVE DATA GD 0 1 2 3 | DISPLAY LINE | SF 0 | SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|
| | | | LIGHT EMISSION PATTERN | | | | | | | | | | | | | | | | | | | | | | | | | |
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ⊙ | | | | | | | | | | | | | | | | | | | | | | 4 |
| | 8N-6 | | ⊙ | | | | | | | | | | | | | | | | | | | | | | | | | 1 |
| | 8N-5 | | ○ | ○ | ○ | ○ | ○ | ⊙ | | | | | | | | | | | | | | | | | | | | 6 |
| | 8N-4 | | ○ | ○ | ⊙ | | | | | | | | | | | | | | | | | | | | | | | 3 |
| | 8N-3 | | ○ | ○ | ○ | ○ | ○ | ○ | ○ | ⊙ | | | | | | | | | | | | | | | | | | 8 |
| | 8N-2 | | ○ | ○ | ○ | ○ | ⊙ | | | | | | | | | | | | | | | | | | | | | 5 |
| | 8N-1 | | ○ | ⊙ | | | | | | | | | | | | | | | | | | | | | | | | 2 |
| | 8N | | ○ | ○ | ○ | ○ | ○ | ○ | ⊙ | | | | | | | | | | | | | | | | | | | 7 |
| 0 0 1 0 | 8N-7 | | ○ | ○ | ○ | ○ | ○ | ○ | ○ | ○ | ○ | ○ | ○ | ⊙ | | | | | | | | | | | | | | 12 |
| | 8N-6 | | ○ | ○ | ○ | ○ | ○ | ○ | ○ | ○ | ⊙ | | | | | | | | | | | | | | | | | 9 |
| | 8N-5 | | ○ | ○ | ○ | ○ | ○ | ○ | ○ | ○ | ○ | ○ | ○ | ○ | ○ | ⊙ | | | | | | | | | | | | 14 |
| | 8N-4 | | ○ | ○ | ○ | ○ | ○ | ○ | ○ | ○ | ○ | ○ | ⊙ | | | | | | | | | | | | | | | 11 |
| | 8N-3 | | ○ | ○ | ○ | ○ | ○ | ○ | ○ | ○ | ○ | ○ | ○ | ○ | ○ | ○ | ○ | ⊙ | | | | | | | | | | 16 |
| | 8N-2 | | ○ | ○ | ○ | ○ | ○ | ○ | ○ | ○ | ○ | ○ | ○ | ○ | ⊙ | | | | | | | | | | | | | 13 |
| | 8N-1 | | ○ | ○ | ○ | ○ | ○ | ○ | ○ | ○ | ○ | ⊙ | | | | | | | | | | | | | | | | 10 |
| | 8N | | ○ | ○ | ○ | ○ | ○ | ○ | ○ | ○ | ○ | ○ | ○ | ○ | ○ | ○ | ⊙ | | | | | | | | | | | 15 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | 8N-6 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-4 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N-1 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.9

DISPLAY LINE

LUMINANCE

| PIXEL DRIVE DATA GD 0 1 2 3 | | SF 0 | LIGHT EMISSION PATTERN SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ○ | ⊙ | | | | | | | | | | | | | | | | | | | | 6 |
| | 8N-6 | | ○ | ○ | ⊙ | | | | | | | | | | | | | | | | | | | | | | | 3 |
| | 8N-5 | | ○ | ○ | ○ | ○ | ○ | ○ | ○ | ⊙ | | | | | | | | | | | | | | | | | | 8 |
| | 8N-4 | | ○ | ○ | ○ | ○ | ⊙ | | | | | | | | | | | | | | | | | | | | | 5 |
| | 8N-3 | | ○ | ⊙ | | | | | | | | | | | | | | | | | | | | | | | | 2 |
| | 8N-2 | | ○ | ○ | ○ | ○ | ○ | ○ | ⊙ | | | | | | | | | | | | | | | | | | | 7 |
| | 8N-1 | | ○ | ○ | ○ | ⊙ | | | | | | | | | | | | | | | | | | | | | | 4 |
| | 8N | | ⊙ | | | | | | | | | | | | | | | | | | | | | | | | | 1 |
| 0 0 1 0 | 8N-7 | | ○ | ○ | ○ | ○ | ○ | ○ | ○ | ○ | ○ | ○ | ○ | ○ | ○ | ⊙ | | | | | | | | | | | | 14 |
| | 8N-6 | | ○ | ○ | ○ | ○ | ○ | ○ | ○ | ○ | ○ | ○ | ⊙ | | | | | | | | | | | | | | | 11 |
| | 8N-5 | | ○ | ○ | ○ | ○ | ○ | ○ | ○ | ○ | ○ | ○ | ○ | ○ | ○ | ○ | ○ | ⊙ | | | | | | | | | | 16 |
| | 8N-4 | | ○ | ○ | ○ | ○ | ○ | ○ | ○ | ○ | ○ | ○ | ○ | ○ | ⊙ | | | | | | | | | | | | | 13 |
| | 8N-3 | | ○ | ○ | ○ | ○ | ○ | ○ | ○ | ○ | ○ | ⊙ | | | | | | | | | | | | | | | | 10 |
| | 8N-2 | | ○ | ○ | ○ | ○ | ○ | ○ | ○ | ○ | ○ | ○ | ○ | ○ | ○ | ○ | ⊙ | | | | | | | | | | | 15 |
| | 8N-1 | | ○ | ○ | ○ | ○ | ○ | ○ | ○ | ○ | ○ | ○ | ○ | ⊙ | | | | | | | | | | | | | | 12 |
| | 8N | | ○ | ○ | ○ | ○ | ○ | ○ | ○ | ○ | ⊙ | | | | | | | | | | | | | | | | | 9 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-6 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N-3 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | 8N | | ○ | ○ | ○ | ○ | ○ | ○ | ○ | ○ | ○ | ○ | ○ | ○ | ○ | ○ | ○ | ○ | ⊙ | | | | | | | | | 17 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.10

| PIXEL DRIVE DATA GD 0 1 2 3 | DISPLAY LINE | SF 0 | SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ⊙ | | | | | | | | | | | | | | | | | | | | | | | | 2 |
| | 8N-6 | | ○ | ○ | ○ | ○ | ○ | ○ | ⊙ | | | | | | | | | | | | | | | | | | | 7 |
| | 8N-5 | | ○ | ○ | ○ | ⊙ | | | | | | | | | | | | | | | | | | | | | | 4 |
| | 8N-4 | | ⊙ | | | | | | | | | | | | | | | | | | | | | | | | | 1 |
| | 8N-3 | | ○ | ○ | ○ | ○ | ○ | ⊙ | | | | | | | | | | | | | | | | | | | | 6 |
| | 8N-2 | | ○ | ○ | ⊙ | | | | | | | | | | | | | | | | | | | | | | | 3 |
| | 8N-1 | | ○ | ○ | ○ | ○ | ○ | ○ | ○ | ⊙ | | | | | | | | | | | | | | | | | | 8 |
| | 8N | | ○ | ○ | ○ | ○ | ⊙ | | | | | | | | | | | | | | | | | | | | | 5 |
| 0 0 1 0 | 8N-7 | | ○ | ○ | ○ | ○ | ○ | ○ | ○ | ○ | ○ | ⊙ | | | | | | | | | | | | | | | | 10 |
| | 8N-6 | | ○ | ○ | ○ | ○ | ○ | ○ | ○ | ○ | ○ | ○ | ○ | ○ | ○ | ○ | ⊙ | | | | | | | | | | | 15 |
| | 8N-5 | | ○ | ○ | ○ | ○ | ○ | ○ | ○ | ○ | ○ | ○ | ○ | ⊙ | | | | | | | | | | | | | | 12 |
| | 8N-4 | | ○ | ○ | ○ | ○ | ○ | ○ | ○ | ○ | ⊙ | | | | | | | | | | | | | | | | | 9 |
| | 8N-3 | | ○ | ○ | ○ | ○ | ○ | ○ | ○ | ○ | ○ | ○ | ○ | ○ | ○ | ⊙ | | | | | | | | | | | | 14 |
| | 8N-2 | | ○ | ○ | ○ | ○ | ○ | ○ | ○ | ○ | ○ | ○ | ⊙ | | | | | | | | | | | | | | | 11 |
| | 8N-1 | | ○ | ○ | ○ | ○ | ○ | ○ | ○ | ○ | ○ | ○ | ○ | ○ | ○ | ○ | ○ | ⊙ | | | | | | | | | | 16 |
| | 8N | | ○ | ○ | ○ | ○ | ○ | ○ | ○ | ○ | ○ | ○ | ○ | ○ | ⊙ | | | | | | | | | | | | | 13 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | 8N-4 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-2 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.11

DISPLAY LINE

LUMINANCE

| PIXEL DRIVE DATA GD 0 1 2 3 | | SF 0 | LIGHT EMISSION PATTERN SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ○ | ○ | ⊙ | | | | | | | | | | | | | | | | | | | 7 |
| | 8N-6 | | ○ | ○ | ○ | ⊙ | | | | | | | | | | | | | | | | | | | | | | 4 |
| | 8N-5 | | ⊙ | | | | | | | | | | | | | | | | | | | | | | | | | 1 |
| | 8N-4 | | ○ | ○ | ○ | ○ | ○ | ⊙ | | | | | | | | | | | | | | | | | | | | 6 |
| | 8N-3 | | ○ | ○ | ⊙ | | | | | | | | | | | | | | | | | | | | | | | 3 |
| | 8N-2 | | ○ | ○ | ○ | ○ | ○ | ○ | ○ | ⊙ | | | | | | | | | | | | | | | | | | 8 |
| | 8N-1 | | ○ | ○ | ○ | ○ | ⊙ | | | | | | | | | | | | | | | | | | | | | 5 |
| | 8N | | ○ | ⊙ | | | | | | | | | | | | | | | | | | | | | | | | 2 |
| 0 0 1 0 | 8N-7 | | ○ | ○ | ○ | ○ | ○ | ○ | ○ | ○ | ○ | ○ | ○ | ○ | ○ | ○ | ⊙ | | | | | | | | | | | 15 |
| | 8N-6 | | ○ | ○ | ○ | ○ | ○ | ○ | ○ | ○ | ○ | ○ | ○ | ⊙ | | | | | | | | | | | | | | 12 |
| | 8N-5 | | ○ | ○ | ○ | ○ | ○ | ○ | ○ | ○ | ⊙ | | | | | | | | | | | | | | | | | 9 |
| | 8N-4 | | ○ | ○ | ○ | ○ | ○ | ○ | ○ | ○ | ○ | ○ | ○ | ○ | ○ | ⊙ | | | | | | | | | | | | 14 |
| | 8N-3 | | ○ | ○ | ○ | ○ | ○ | ○ | ○ | ○ | ○ | ○ | ⊙ | | | | | | | | | | | | | | | 11 |
| | 8N-2 | | ○ | ○ | ○ | ○ | ○ | ○ | ○ | ○ | ○ | ○ | ○ | ○ | ○ | ○ | ○ | ⊙ | | | | | | | | | | 16 |
| | 8N-1 | | ○ | ○ | ○ | ○ | ○ | ○ | ○ | ○ | ○ | ○ | ○ | ○ | ⊙ | | | | | | | | | | | | | 13 |
| | 8N | | ○ | ○ | ○ | ○ | ○ | ○ | ○ | ○ | ○ | ⊙ | | | | | | | | | | | | | | | | 10 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | 8N-5 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-3 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N | | ○ | ○ | ○ | ○ | ○ | ○ | ○ | ○ | ○ | ○ | ○ | ○ | ○ | ○ | ○ | ○ | ○ | ⊙ | | | | | | | | 18 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.12

| PIXEL DRIVE DATA GD 0 1 2 3 | DISPLAY LINE | SF 0 | LIGHT EMISSION PATTERN SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ⊙ | | | | | | | | | | | | | | | | | | | | | | | 3 |
| | 8N-6 | | ○ | ○ | ○ | ○ | ○ | ○ | ○ | ⊙ | | | | | | | | | | | | | | | | | | 8 |
| | 8N-5 | | ○ | ○ | ○ | ○ | ⊙ | | | | | | | | | | | | | | | | | | | | | 5 |
| | 8N-4 | | ○ | ⊙ | | | | | | | | | | | | | | | | | | | | | | | | 2 |
| | 8N-3 | | ○ | ○ | ○ | ○ | ○ | ○ | ⊙ | | | | | | | | | | | | | | | | | | | 7 |
| | 8N-2 | | ○ | ○ | ○ | ⊙ | | | | | | | | | | | | | | | | | | | | | | 4 |
| | 8N-1 | | ⊙ | | | | | | | | | | | | | | | | | | | | | | | | | 1 |
| | 8N | | ○ | ○ | ○ | ○ | ○ | ⊙ | | | | | | | | | | | | | | | | | | | | 6 |
| 0 0 1 0 | 8N-7 | | ○ | ○ | ○ | ○ | ○ | ○ | ○ | ○ | ○ | ○ | ⊙ | | | | | | | | | | | | | | | 11 |
| | 8N-6 | | ○ | ○ | ○ | ○ | ○ | ○ | ○ | ○ | ○ | ○ | ○ | ○ | ○ | ○ | ○ | ⊙ | | | | | | | | | | 16 |
| | 8N-5 | | ○ | ○ | ○ | ○ | ○ | ○ | ○ | ○ | ○ | ○ | ○ | ○ | ⊙ | | | | | | | | | | | | | 13 |
| | 8N-4 | | ○ | ○ | ○ | ○ | ○ | ○ | ○ | ○ | ○ | ⊙ | | | | | | | | | | | | | | | | 10 |
| | 8N-3 | | ○ | ○ | ○ | ○ | ○ | ○ | ○ | ○ | ○ | ○ | ○ | ○ | ○ | ○ | ⊙ | | | | | | | | | | | 15 |
| | 8N-2 | | ○ | ○ | ○ | ○ | ○ | ○ | ○ | ○ | ○ | ○ | ○ | ⊙ | | | | | | | | | | | | | | 12 |
| | 8N-1 | | ○ | ○ | ○ | ○ | ○ | ○ | ○ | ○ | ⊙ | | | | | | | | | | | | | | | | | 9 |
| | 8N | | ○ | ○ | ○ | ○ | ○ | ○ | ○ | ○ | ○ | ○ | ○ | ○ | ○ | ⊙ | | | | | | | | | | | | 14 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N-4 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | 8N-1 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.13

| PIXEL DRIVE DATA GD 0 1 2 3 | DISPLAY LINE | SF 0 | LIGHT EMISSION PATTERN SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ⊙ | | | | | | | | | | | | | | | | | | | | | 5 |
| | 8N-6 | | ○ | ⊙ | | | | | | | | | | | | | | | | | | | | | | | | 2 |
| | 8N-5 | | ○ | ○ | ○ | ○ | ○ | ○ | ⊙ | | | | | | | | | | | | | | | | | | | 7 |
| | 8N-4 | | ○ | ○ | ○ | ⊙ | | | | | | | | | | | | | | | | | | | | | | 4 |
| | 8N-3 | | ⊙ | | | | | | | | | | | | | | | | | | | | | | | | | 1 |
| | 8N-2 | | ○ | ○ | ○ | ○ | ○ | ⊙ | | | | | | | | | | | | | | | | | | | | 6 |
| | 8N-1 | | ○ | ○ | ⊙ | | | | | | | | | | | | | | | | | | | | | | | 3 |
| | 8N | | ○ | ○ | ○ | ○ | ○ | ○ | ○ | ⊙ | | | | | | | | | | | | | | | | | | 8 |
| 0 0 1 0 | 8N-7 | | ○ | ○ | ○ | ○ | ○ | ○ | ○ | ○ | ○ | ○ | ○ | ○ | ⊙ | | | | | | | | | | | | | 13 |
| | 8N-6 | | ○ | ○ | ○ | ○ | ○ | ○ | ○ | ○ | ○ | ⊙ | | | | | | | | | | | | | | | | 10 |
| | 8N-5 | | ○ | ○ | ○ | ○ | ○ | ○ | ○ | ○ | ○ | ○ | ○ | ○ | ○ | ○ | ⊙ | | | | | | | | | | | 15 |
| | 8N-4 | | ○ | ○ | ○ | ○ | ○ | ○ | ○ | ○ | ○ | ○ | ○ | ⊙ | | | | | | | | | | | | | | 12 |
| | 8N-3 | | ○ | ○ | ○ | ○ | ○ | ○ | ○ | ○ | ⊙ | | | | | | | | | | | | | | | | | 9 |
| | 8N-2 | | ○ | ○ | ○ | ○ | ○ | ○ | ○ | ○ | ○ | ○ | ○ | ○ | ○ | ⊙ | | | | | | | | | | | | 14 |
| | 8N-1 | | ○ | ○ | ○ | ○ | ○ | ○ | ○ | ○ | ○ | ○ | ⊙ | | | | | | | | | | | | | | | 11 |
| | 8N | | ○ | ○ | ○ | ○ | ○ | ○ | ○ | ○ | ○ | ○ | ○ | ○ | ○ | ○ | ○ | ⊙ | | | | | | | | | | 16 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N-6 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| | 8N-3 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-1 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG.14

DISPLAY LINE

LUMINANCE

| PIXEL DRIVE DATA GD 0 1 2 3 | | SF 0 | SF 11 | SF 12 | SF 13 | SF 14 | SF 15 | SF 16 | SF 17 | SF 18 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ⊙ | | | | | | | | | | | | | | | | | | | | | | | | | 1 |
| | 8N-6 | | ○ | ○ | ○ | ○ | ○ | ⊙ | | | | | | | | | | | | | | | | | | | | 6 |
| | 8N-5 | | ○ | ○ | ⊙ | | | | | | | | | | | | | | | | | | | | | | | 3 |
| | 8N-4 | | ○ | ○ | ○ | ○ | ○ | ○ | ○ | ⊙ | | | | | | | | | | | | | | | | | | 8 |
| | 8N-3 | | ○ | ○ | ○ | ○ | ⊙ | | | | | | | | | | | | | | | | | | | | | 5 |
| | 8N-2 | | ○ | ⊙ | | | | | | | | | | | | | | | | | | | | | | | | 2 |
| | 8N-1 | | ○ | ○ | ○ | ○ | ○ | ○ | ⊙ | | | | | | | | | | | | | | | | | | | 7 |
| | 8N | | ○ | ○ | ○ | ⊙ | | | | | | | | | | | | | | | | | | | | | | 4 |
| 0 0 1 0 | 8N-7 | | ○ | ○ | ○ | ○ | ○ | ○ | ○ | ○ | ⊙ | | | | | | | | | | | | | | | | | 9 |
| | 8N-6 | | ○ | ○ | ○ | ○ | ○ | ○ | ○ | ○ | ○ | ○ | ○ | ○ | ○ | ⊙ | | | | | | | | | | | | 14 |
| | 8N-5 | | ○ | ○ | ○ | ○ | ○ | ○ | ○ | ○ | ○ | ○ | ⊙ | | | | | | | | | | | | | | | 11 |
| | 8N-4 | | ○ | ○ | ○ | ○ | ○ | ○ | ○ | ○ | ○ | ○ | ○ | ○ | ○ | ○ | ○ | ⊙ | | | | | | | | | | 16 |
| | 8N-3 | | ○ | ○ | ○ | ○ | ○ | ○ | ○ | ○ | ○ | ○ | ○ | ○ | ⊙ | | | | | | | | | | | | | 13 |
| | 8N-2 | | ○ | ○ | ○ | ○ | ○ | ○ | ○ | ○ | ○ | ⊙ | | | | | | | | | | | | | | | | 10 |
| | 8N-1 | | ○ | ○ | ○ | ○ | ○ | ○ | ○ | ○ | ○ | ○ | ○ | ○ | ○ | ○ | ⊙ | | | | | | | | | | | 15 |
| | 8N | | ○ | ○ | ○ | ○ | ○ | ○ | ○ | ○ | ○ | ○ | ○ | ⊙ | | | | | | | | | | | | | | 12 |
| 0 0 0 1 | 8N-7 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-5 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N-2 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

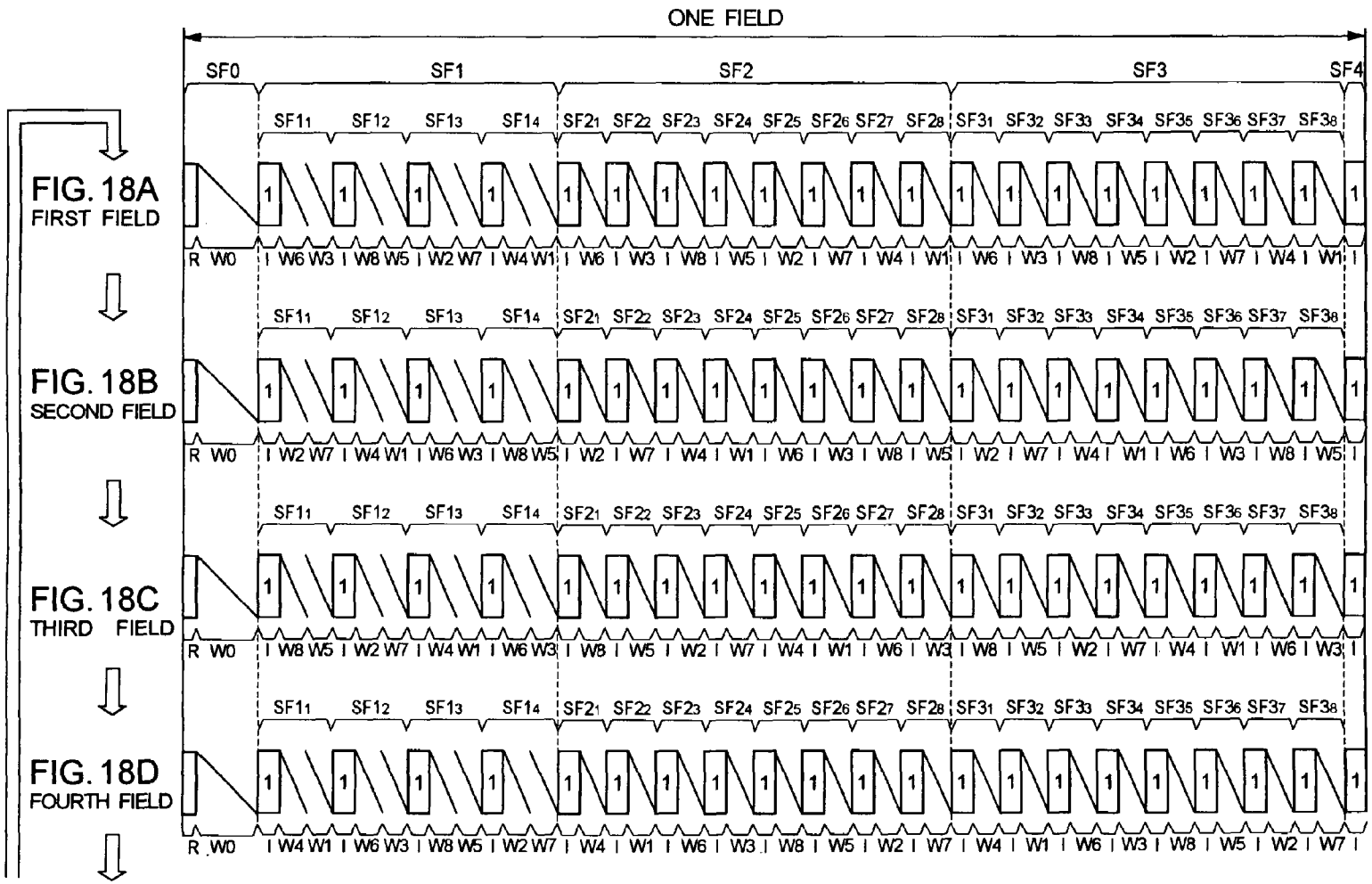
FIG. 18A FIRST FIELD
FIG. 18B SECOND FIELD
FIG. 18C THIRD FIELD
FIG. 18D FOURTH FIELD

ONE FIELD
SF0
SF1
SF2
SF3
SF4

FIFTH FIELD

SIXTH FIELD

SEVENTH FIELD

EIGHTH FIELD

FIG.19

| | PIXEL DRIVE DATA GD 0 1 2 3 | DISPLAY LINE | SF 0 | SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|---|
| FIRST GRAYSCALE DRIVING | 1 0 0 0 | 8N-7 | ● | | | | | | | | | | | | | | | | | | | | | | 0 |
| | | 8N-6 | ● | | | | | | | | | | | | | | | | | | | | | | 0 |
| | | 8N-5 | ● | | | | | | | | | | | | | | | | | | | | | | 0 |
| | | 8N-4 | ● | | | | | | | | | | | | | | | | | | | | | | 0 |
| | | 8N-3 | ● | | | | | | | | | | | | | | | | | | | | | | 0 |
| | | 8N-2 | ● | | | | | | | | | | | | | | | | | | | | | | 0 |
| | | 8N-1 | ● | | | | | | | | | | | | | | | | | | | | | | 0 |
| | | 8N | ● | | | | | | | | | | | | | | | | | | | | | | 0 |
| SECOND GRAYSCALE DRIVING | 0 1 0 0 | 8N-7 | | ○ | ○ | ○ | ⊙ | | | | | | | | | | | | | | | | | | 4 |
| | | 8N-6 | | ○ | ○ | ⊙ | | | | | | | | | | | | | | | | | | | 3 |
| | | 8N-5 | | ⊙ | | | | | | | | | | | | | | | | | | | | | 1 |
| | | 8N-4 | | ○ | ○ | ○ | ⊙ | | | | | | | | | | | | | | | | | | 4 |
| | | 8N-3 | | ○ | ⊙ | | | | | | | | | | | | | | | | | | | | 2 |
| | | 8N-2 | | ⊙ | | | | | | | | | | | | | | | | | | | | | 1 |
| | | 8N-1 | | ○ | ○ | ⊙ | | | | | | | | | | | | | | | | | | | 3 |
| | | 8N | | ○ | ⊙ | | | | | | | | | | | | | | | | | | | | 2 |
| THIRD GRAYSCALE DRIVING | 0 0 1 0 | 8N-7 | | ○ | ○ | ○ | ○ | ○ | ○ | ○ | ○ | ○ | ○ | ○ | ⊙ | | | | | | | | | | 12 |
| | | 8N-6 | | ○ | ○ | ○ | ○ | ○ | ○ | ○ | ○ | ⊙ | | | | | | | | | | | | | 9 |
| | | 8N-5 | | ○ | ○ | ○ | ○ | ○ | ⊙ | | | | | | | | | | | | | | | | 6 |
| | | 8N-4 | | ○ | ○ | ○ | ○ | ○ | ○ | ○ | ○ | ○ | ○ | ⊙ | | | | | | | | | | | 11 |
| | | 8N-3 | | ○ | ○ | ○ | ○ | ○ | ○ | ○ | ⊙ | | | | | | | | | | | | | | 8 |
| | | 8N-2 | | ○ | ○ | ○ | ○ | ⊙ | | | | | | | | | | | | | | | | | 5 |
| | | 8N-1 | | ○ | ○ | ○ | ○ | ○ | ○ | ○ | ○ | ○ | ⊙ | | | | | | | | | | | | 10 |
| | | 8N | | ○ | ○ | ○ | ○ | ○ | ○ | ⊙ | | | | | | | | | | | | | | | 7 |
| FOURTH GRAYSCALE DRIVING | 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| | | 8N-6 | | ○ | ○ | ○ | ○ | ○ | ○ | ○ | ○ | ○ | ○ | ○ | ○ | ○ | ○ | ○ | ○ | ⊙ | | | | | 17 |
| | | 8N-5 | | ○ | ○ | ○ | ○ | ○ | ○ | ○ | ○ | ○ | ○ | ○ | ○ | ○ | ⊙ | | | | | | | | 14 |
| | | 8N-4 | | ○ | ○ | ○ | ○ | ○ | ○ | ○ | ○ | ○ | ○ | ○ | ○ | ○ | ○ | ○ | ○ | ○ | ○ | ⊙ | | | 19 |
| | | 8N-3 | | ○ | ○ | ○ | ○ | ○ | ○ | ○ | ○ | ○ | ○ | ○ | ○ | ○ | ○ | ○ | ⊙ | | | | | | 16 |
| | | 8N-2 | | ○ | ○ | ○ | ○ | ○ | ○ | ○ | ○ | ○ | ○ | ○ | ○ | ⊙ | | | | | | | | | 13 |
| | | 8N-1 | | ○ | ○ | ○ | ○ | ○ | ○ | ○ | ○ | ○ | ○ | ○ | ○ | ○ | ○ | ○ | ○ | ○ | ⊙ | | | | 18 |
| | | 8N | | ○ | ○ | ○ | ○ | ○ | ○ | ○ | ○ | ○ | ○ | ○ | ○ | ○ | ○ | ⊙ | | | | | | | 15 |
| FIFTH GRAYSCALE DRIVING | 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.20

| PIXEL DRIVE DATA GD 0 1 2 3 | DISPLAY LINE | SF 0 | LIGHT EMISSION PATTERN SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | 0 |
| | 8N-6 | ● | | | | | | | | | | | | | | | | | | | | | | 0 |
| | 8N-5 | ● | | | | | | | | | | | | | | | | | | | | | | 0 |
| | 8N-4 | ● | | | | | | | | | | | | | | | | | | | | | | 0 |
| | 8N-3 | ● | | | | | | | | | | | | | | | | | | | | | | 0 |
| | 8N-2 | ● | | | | | | | | | | | | | | | | | | | | | | 0 |
| | 8N-1 | ● | | | | | | | | | | | | | | | | | | | | | | 0 |
| | 8N | ● | | | | | | | | | | | | | | | | | | | | | | 0 |
| 0 1 0 0 | 8N-7 | | ○ | ⊙ | | | | | | | | | | | | | | | | | | | | 2 |
| | 8N-6 | | ⊙ | | | | | | | | | | | | | | | | | | | | | 1 |
| | 8N-5 | | ○ | ○ | ⊙ | | | | | | | | | | | | | | | | | | | 3 |
| | 8N-4 | | ○ | ⊙ | | | | | | | | | | | | | | | | | | | | 2 |
| | 8N-3 | | ○ | ○ | ○ | ⊙ | | | | | | | | | | | | | | | | | | 4 |
| | 8N-2 | | ○ | ○ | ⊙ | | | | | | | | | | | | | | | | | | | 3 |
| | 8N-1 | | ⊙ | | | | | | | | | | | | | | | | | | | | | 1 |
| | 8N | | ○ | ○ | ○ | ⊙ | | | | | | | | | | | | | | | | | | 4 |
| 0 0 1 0 | 8N-7 | | ○ | ○ | ○ | ○ | ○ | ○ | ○ | ⊙ | | | | | | | | | | | | | | 8 |
| | 8N-6 | | ○ | ○ | ○ | ○ | ⊙ | | | | | | | | | | | | | | | | | 5 |
| | 8N-5 | | ○ | ○ | ○ | ○ | ○ | ○ | ○ | ○ | ○ | ⊙ | | | | | | | | | | | | 10 |
| | 8N-4 | | ○ | ○ | ○ | ○ | ○ | ○ | ⊙ | | | | | | | | | | | | | | | 7 |
| | 8N-3 | | ○ | ○ | ○ | ○ | ○ | ○ | ○ | ○ | ○ | ○ | ○ | ⊙ | | | | | | | | | | 12 |
| | 8N-2 | | ○ | ○ | ○ | ○ | ○ | ○ | ○ | ○ | ⊙ | | | | | | | | | | | | | 9 |
| | 8N-1 | | ○ | ○ | ○ | ○ | ○ | ⊙ | | | | | | | | | | | | | | | | 6 |
| | 8N | | ○ | ○ | ○ | ○ | ○ | ○ | ○ | ○ | ○ | ○ | ⊙ | | | | | | | | | | | 11 |
| 0 0 0 1 | 8N-7 | | ○ | ○ | ○ | ○ | ○ | ○ | ○ | ○ | ○ | ○ | ○ | ○ | ○ | ○ | ○ | ⊙ | | | | | | 16 |
| | 8N-6 | | ○ | ○ | ○ | ○ | ○ | ○ | ○ | ○ | ○ | ○ | ○ | ○ | ⊙ | | | | | | | | | 13 |
| | 8N-5 | | ○ | ○ | ○ | ○ | ○ | ○ | ○ | ○ | ○ | ○ | ○ | ○ | ○ | ○ | ○ | ○ | ○ | ⊙ | | | | 18 |
| | 8N-4 | | ○ | ○ | ○ | ○ | ○ | ○ | ○ | ○ | ○ | ○ | ○ | ○ | ○ | ○ | ⊙ | | | | | | | 15 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| | 8N-2 | | ○ | ○ | ○ | ○ | ○ | ○ | ○ | ○ | ○ | ○ | ○ | ○ | ○ | ○ | ○ | ○ | ⊙ | | | | | 17 |
| | 8N-1 | | ○ | ○ | ○ | ○ | ○ | ○ | ○ | ○ | ○ | ○ | ○ | ○ | ○ | ⊙ | | | | | | | | 14 |
| | 8N | | ○ | ○ | ○ | ○ | ○ | ○ | ○ | ○ | ○ | ○ | ○ | ○ | ○ | ○ | ○ | ○ | ○ | ○ | ⊙ | | | 19 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.21

DISPLAY LINE

LUMINANCE

| PIXEL DRIVE DATA GD 0 1 2 3 | | SF 0 | SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | |
|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | 0 |
| | 8N-6 | ● | | | | | | | | | | | | | | | | | | | | | | 0 |
| | 8N-5 | ● | | | | | | | | | | | | | | | | | | | | | | 0 |
| | 8N-4 | ● | | | | | | | | | | | | | | | | | | | | | | 0 |
| | 8N-3 | ● | | | | | | | | | | | | | | | | | | | | | | 0 |
| | 8N-2 | ● | | | | | | | | | | | | | | | | | | | | | | 0 |
| | 8N-1 | ● | | | | | | | | | | | | | | | | | | | | | | 0 |
| | 8N | ● | | | | | | | | | | | | | | | | | | | | | | 0 |
| 0 1 0 0 | 8N-7 | | ○ | ○ | ⊙ | | | | | | | | | | | | | | | | | | | 3 |
| | 8N-6 | | ○ | ⊙ | | | | | | | | | | | | | | | | | | | | 2 |
| | 8N-5 | | ○ | ○ | ○ | ⊙ | | | | | | | | | | | | | | | | | | 4 |
| | 8N-4 | | ○ | ○ | ⊙ | | | | | | | | | | | | | | | | | | | 3 |
| | 8N-3 | | ⊙ | | | | | | | | | | | | | | | | | | | | | 1 |
| | 8N-2 | | ○ | ○ | ○ | ⊙ | | | | | | | | | | | | | | | | | | 4 |
| | 8N-1 | | ○ | ⊙ | | | | | | | | | | | | | | | | | | | | 2 |
| | 8N | | ⊙ | | | | | | | | | | | | | | | | | | | | | 1 |
| 0 0 1 0 | 8N-7 | | ○ | ○ | ○ | ○ | ○ | ○ | ○ | ○ | ○ | ⊙ | | | | | | | | | | | | 10 |
| | 8N-6 | | ○ | ○ | ○ | ○ | ○ | ○ | ⊙ | | | | | | | | | | | | | | | 7 |
| | 8N-5 | | ○ | ○ | ○ | ○ | ○ | ○ | ○ | ○ | ○ | ○ | ○ | ⊙ | | | | | | | | | | 12 |
| | 8N-4 | | ○ | ○ | ○ | ○ | ○ | ○ | ○ | ○ | ⊙ | | | | | | | | | | | | | 9 |
| | 8N-3 | | ○ | ○ | ○ | ○ | ○ | ⊙ | | | | | | | | | | | | | | | | 6 |
| | 8N-2 | | ○ | ○ | ○ | ○ | ○ | ○ | ○ | ○ | ○ | ○ | ⊙ | | | | | | | | | | | 11 |
| | 8N-1 | | ○ | ○ | ○ | ○ | ○ | ○ | ○ | ⊙ | | | | | | | | | | | | | | 8 |
| | 8N | | ○ | ○ | ○ | ○ | ⊙ | | | | | | | | | | | | | | | | | 5 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ⊙ | | | | 18 |
| | 8N-6 | | ○ | ○ | ○ | ○ | ○ | ○ | ○ | ○ | ○ | ○ | ○ | ○ | ○ | ○ | ⊙ | | | | | | | 15 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| | 8N-4 | | ○ | ○ | ○ | ○ | ○ | ○ | ○ | ○ | ○ | ○ | ○ | ○ | ○ | ○ | ○ | ○ | ⊙ | | | | | 17 |
| | 8N-3 | | ○ | ○ | ○ | ○ | ○ | ○ | ○ | ○ | ○ | ○ | ○ | ○ | ○ | ⊙ | | | | | | | | 14 |
| | 8N-2 | | ○ | ○ | ○ | ○ | ○ | ○ | ○ | ○ | ○ | ○ | ○ | ○ | ○ | ○ | ○ | ○ | ○ | ○ | ⊙ | | | 19 |
| | 8N-1 | | ○ | ○ | ○ | ○ | ○ | ○ | ○ | ○ | ○ | ○ | ○ | ○ | ○ | ○ | ○ | ⊙ | | | | | | 16 |
| | 8N | | ○ | ○ | ○ | ○ | ○ | ○ | ○ | ○ | ○ | ○ | ○ | ○ | ⊙ | | | | | | | | | 13 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.22

DISPLAY LINE

LUMINANCE

| PIXEL DRIVE DATA GD 0 1 2 3 | | LIGHT EMISSION PATTERN | | |

FIG.23

DISPLAY LINE

LUMINANCE

| PIXEL DRIVE DATA GD 0 1 2 3 | | LIGHT EMISSION PATTERN | | | | | | | | | | | | | | | | | | | | | | | | | |
|---|---|---|---|---|---|---|---|---|---|---|---|---|---|---|---|---|---|---|---|---|---|---|---|---|---|---|---|
| | | SF 0 | SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | |
| 1 0 0 0 | 8N-7 | ● | | | | | | | | | | | | | | | | | | | | | | 0 |
| | 8N-6 | ● | | | | | | | | | | | | | | | | | | | | | | 0 |
| | 8N-5 | ● | | | | | | | | | | | | | | | | | | | | | | 0 |
| | 8N-4 | ● | | | | | | | | | | | | | | | | | | | | | | 0 |
| | 8N-3 | ● | | | | | | | | | | | | | | | | | | | | | | 0 |
| | 8N-2 | ● | | | | | | | | | | | | | | | | | | | | | | 0 |
| | 8N-1 | ● | | | | | | | | | | | | | | | | | | | | | | 0 |
| | 8N | ● | | | | | | | | | | | | | | | | | | | | | | 0 |
| 0 1 0 0 | 8N-7 | | ○ | ○ | ○ | ⊙ | | | | | | | | | | | | | | | | | | 4 |
| | 8N-6 | | ○ | ⊙ | | | | | | | | | | | | | | | | | | | | 2 |
| | 8N-5 | | ⊙ | | | | | | | | | | | | | | | | | | | | | 1 |
| | 8N-4 | | ○ | ○ | ⊙ | | | | | | | | | | | | | | | | | | | 3 |
| | 8N-3 | | ○ | ⊙ | | | | | | | | | | | | | | | | | | | | 2 |
| | 8N-2 | | ○ | ○ | ○ | ⊙ | | | | | | | | | | | | | | | | | | 4 |
| | 8N-1 | | ○ | ○ | ⊙ | | | | | | | | | | | | | | | | | | | 3 |
| | 8N | | ⊙ | | | | | | | | | | | | | | | | | | | | | 1 |
| 0 0 1 0 | 8N-7 | | ○ | ○ | ○ | ○ | ○ | ○ | ○ | ○ | ○ | ○ | ⊙ | | | | | | | | | | | 11 |
| | 8N-6 | | ○ | ○ | ○ | ○ | ○ | ○ | ○ | ⊙ | | | | | | | | | | | | | | 8 |
| | 8N-5 | | ○ | ○ | ○ | ○ | ⊙ | | | | | | | | | | | | | | | | | 5 |
| | 8N-4 | | ○ | ○ | ○ | ○ | ○ | ○ | ○ | ○ | ○ | ⊙ | | | | | | | | | | | | 10 |
| | 8N-3 | | ○ | ○ | ○ | ○ | ○ | ○ | ⊙ | | | | | | | | | | | | | | | 7 |
| | 8N-2 | | ○ | ○ | ○ | ○ | ○ | ○ | ○ | ○ | ○ | ○ | ○ | ⊙ | | | | | | | | | | 12 |
| | 8N-1 | | ○ | ○ | ○ | ○ | ○ | ○ | ○ | ○ | ⊙ | | | | | | | | | | | | | 9 |
| | 8N | | ○ | ○ | ○ | ○ | ○ | ⊙ | | | | | | | | | | | | | | | | 6 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ⊙ | | | 19 |
| | 8N-6 | | ○ | ○ | ○ | ○ | ○ | ○ | ○ | ○ | ○ | ○ | ○ | ○ | ○ | ○ | ○ | ⊙ | | | | | | 16 |
| | 8N-5 | | ○ | ○ | ○ | ○ | ○ | ○ | ○ | ○ | ○ | ○ | ○ | ○ | ⊙ | | | | | | | | | 13 |
| | 8N-4 | | ○ | ○ | ○ | ○ | ○ | ○ | ○ | ○ | ○ | ○ | ○ | ○ | ○ | ○ | ○ | ○ | ○ | ⊙ | | | | 18 |
| | 8N-3 | | ○ | ○ | ○ | ○ | ○ | ○ | ○ | ○ | ○ | ○ | ○ | ○ | ○ | ○ | ⊙ | | | | | | | 15 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| | 8N-1 | | ○ | ○ | ○ | ○ | ○ | ○ | ○ | ○ | ○ | ○ | ○ | ○ | ○ | ○ | ○ | ○ | ⊙ | | | | | 17 |
| | 8N | | ○ | ○ | ○ | ○ | ○ | ○ | ○ | ○ | ○ | ○ | ○ | ○ | ○ | ⊙ | | | | | | | | 14 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.24

DISPLAY LINE

LUMINANCE

| PIXEL DRIVE DATA GD 0 1 2 3 | | SF 0 | SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | |
|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | 0 |
| | 8N-6 | ● | | | | | | | | | | | | | | | | | | | | | | 0 |
| | 8N-5 | ● | | | | | | | | | | | | | | | | | | | | | | 0 |
| | 8N-4 | ● | | | | | | | | | | | | | | | | | | | | | | 0 |
| | 8N-3 | ● | | | | | | | | | | | | | | | | | | | | | | 0 |
| | 8N-2 | ● | | | | | | | | | | | | | | | | | | | | | | 0 |
| | 8N-1 | ● | | | | | | | | | | | | | | | | | | | | | | 0 |
| | 8N | ● | | | | | | | | | | | | | | | | | | | | | | 0 |
| 0 1 0 0 | 8N-7 | | ○ | ⊙ | | | | | | | | | | | | | | | | | | | | 2 |
| | 8N-6 | | ○ | ○ | ○ | ⊙ | | | | | | | | | | | | | | | | | | 4 |
| | 8N-5 | | ○ | ○ | ⊙ | | | | | | | | | | | | | | | | | | | 3 |
| | 8N-4 | | ⊙ | | | | | | | | | | | | | | | | | | | | | 1 |
| | 8N-3 | | ○ | ○ | ○ | ⊙ | | | | | | | | | | | | | | | | | | 4 |
| | 8N-2 | | ○ | ⊙ | | | | | | | | | | | | | | | | | | | | 2 |
| | 8N-1 | | ⊙ | | | | | | | | | | | | | | | | | | | | | 1 |
| | 8N | | ○ | ○ | ⊙ | | | | | | | | | | | | | | | | | | | 3 |
| 0 0 1 0 | 8N-7 | | ○ | ○ | ○ | ○ | ○ | ○ | ⊙ | | | | | | | | | | | | | | | 7 |
| | 8N-6 | | ○ | ○ | ○ | ○ | ○ | ○ | ○ | ○ | ○ | ○ | ○ | ⊙ | | | | | | | | | | 12 |
| | 8N-5 | | ○ | ○ | ○ | ○ | ○ | ○ | ○ | ○ | ⊙ | | | | | | | | | | | | | 9 |
| | 8N-4 | | ○ | ○ | ○ | ○ | ○ | ⊙ | | | | | | | | | | | | | | | | 6 |
| | 8N-3 | | ○ | ○ | ○ | ○ | ○ | ○ | ○ | ○ | ○ | ○ | ⊙ | | | | | | | | | | | 11 |
| | 8N-2 | | ○ | ○ | ○ | ○ | ○ | ○ | ○ | ⊙ | | | | | | | | | | | | | | 8 |
| | 8N-1 | | ○ | ○ | ○ | ○ | ⊙ | | | | | | | | | | | | | | | | | 5 |
| | 8N | | ○ | ○ | ○ | ○ | ○ | ○ | ○ | ○ | ○ | ⊙ | | | | | | | | | | | | 10 |
| 0 0 0 1 | 8N-7 | | ○ | ○ | ○ | ○ | ○ | ○ | ○ | ○ | ○ | ○ | ○ | ○ | ○ | ○ | ⊙ | | | | | | | 15 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| | 8N-5 | | ○ | ○ | ○ | ○ | ○ | ○ | ○ | ○ | ○ | ○ | ○ | ○ | ○ | ○ | ○ | ○ | ⊙ | | | | | 17 |
| | 8N-4 | | ○ | ○ | ○ | ○ | ○ | ○ | ○ | ○ | ○ | ○ | ○ | ○ | ○ | ⊙ | | | | | | | | 14 |
| | 8N-3 | | ○ | ○ | ○ | ○ | ○ | ○ | ○ | ○ | ○ | ○ | ○ | ○ | ○ | ○ | ○ | ○ | ○ | ○ | ⊙ | | | 19 |
| | 8N-2 | | ○ | ○ | ○ | ○ | ○ | ○ | ○ | ○ | ○ | ○ | ○ | ○ | ○ | ○ | ○ | ⊙ | | | | | | 16 |
| | 8N-1 | | ○ | ○ | ○ | ○ | ○ | ○ | ○ | ○ | ○ | ○ | ○ | ○ | ⊙ | | | | | | | | | 13 |
| | 8N | | ○ | ○ | ○ | ○ | ○ | ○ | ○ | ○ | ○ | ○ | ○ | ○ | ○ | ○ | ○ | ○ | ○ | ⊙ | | | | 18 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.25

| PIXEL DRIVE DATA GD 0 1 2 3 | DISPLAY LINE | SF 0 | SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | LUMINANCE |
|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | 0 |
| | 8N-6 | ● | | | | | | | | | | | | | | | | | | | | | | 0 |
| | 8N-5 | ● | | | | | | | | | | | | | | | | | | | | | | 0 |
| | 8N-4 | ● | | | | | | | | | | | | | | | | | | | | | | 0 |
| | 8N-3 | ● | | | | | | | | | | | | | | | | | | | | | | 0 |
| | 8N-2 | ● | | | | | | | | | | | | | | | | | | | | | | 0 |
| | 8N-1 | ● | | | | | | | | | | | | | | | | | | | | | | 0 |
| | 8N | ● | | | | | | | | | | | | | | | | | | | | | | 0 |
| 0 1 0 0 | 8N-7 | | ○ | ○ | ⊙ | | | | | | | | | | | | | | | | | | | 3 |
| | 8N-6 | | ⊙ | | | | | | | | | | | | | | | | | | | | | 1 |
| | 8N-5 | | ○ | ○ | ○ | ⊙ | | | | | | | | | | | | | | | | | | 4 |
| | 8N-4 | | ○ | ⊙ | | | | | | | | | | | | | | | | | | | | 2 |
| | 8N-3 | | ⊙ | | | | | | | | | | | | | | | | | | | | | 1 |
| | 8N-2 | | ○ | ○ | ⊙ | | | | | | | | | | | | | | | | | | | 3 |
| | 8N-1 | | ○ | ⊙ | | | | | | | | | | | | | | | | | | | | 2 |
| | 8N | | ○ | ○ | ○ | ⊙ | | | | | | | | | | | | | | | | | | 4 |
| 0 0 1 0 | 8N-7 | | ○ | ○ | ○ | ○ | ○ | ○ | ○ | ○ | ⊙ | | | | | | | | | | | | | 9 |
| | 8N-6 | | ○ | ○ | ○ | ○ | ○ | ⊙ | | | | | | | | | | | | | | | | 6 |
| | 8N-5 | | ○ | ○ | ○ | ○ | ○ | ○ | ○ | ○ | ○ | ○ | ⊙ | | | | | | | | | | | 11 |
| | 8N-4 | | ○ | ○ | ○ | ○ | ○ | ○ | ○ | ⊙ | | | | | | | | | | | | | | 8 |
| | 8N-3 | | ○ | ○ | ○ | ○ | ⊙ | | | | | | | | | | | | | | | | | 5 |
| | 8N-2 | | ○ | ○ | ○ | ○ | ○ | ○ | ○ | ○ | ○ | ⊙ | | | | | | | | | | | | 10 |
| | 8N-1 | | ○ | ○ | ○ | ○ | ○ | ○ | ⊙ | | | | | | | | | | | | | | | 7 |
| | 8N | | ○ | ○ | ○ | ○ | ○ | ○ | ○ | ○ | ○ | ○ | ○ | ⊙ | | | | | | | | | | 12 |
| 0 0 0 1 | 8N-7 | | ○ | ○ | ○ | ○ | ○ | ○ | ○ | ○ | ○ | ○ | ○ | ○ | ○ | ○ | ○ | ○ | ⊙ | | | | | 17 |
| | 8N-6 | | ○ | ○ | ○ | ○ | ○ | ○ | ○ | ○ | ○ | ○ | ○ | ○ | ○ | ⊙ | | | | | | | | 14 |
| | 8N-5 | | ○ | ○ | ○ | ○ | ○ | ○ | ○ | ○ | ○ | ○ | ○ | ○ | ○ | ○ | ○ | ○ | ○ | ○ | ⊙ | | | 19 |
| | 8N-4 | | ○ | ○ | ○ | ○ | ○ | ○ | ○ | ○ | ○ | ○ | ○ | ○ | ○ | ○ | ○ | ⊙ | | | | | | 16 |
| | 8N-3 | | ○ | ○ | ○ | ○ | ○ | ○ | ○ | ○ | ○ | ○ | ○ | ○ | ⊙ | | | | | | | | | 13 |
| | 8N-2 | | ○ | ○ | ○ | ○ | ○ | ○ | ○ | ○ | ○ | ○ | ○ | ○ | ○ | ○ | ○ | ○ | ○ | ⊙ | | | | 18 |
| | 8N-1 | | ○ | ○ | ○ | ○ | ○ | ○ | ○ | ○ | ○ | ○ | ○ | ○ | ○ | ○ | ⊙ | | | | | | | 15 |
| | 8N | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.26

DISPLAY LINE

LUMINANCE

| PIXEL DRIVE DATA GD 0 1 2 3 | | SF 0 | LIGHT EMISSION PATTERN SF 11 | SF 12 | SF 13 | SF 14 | SF 21 | SF 22 | SF 23 | SF 24 | SF 25 | SF 26 | SF 27 | SF 28 | SF 31 | SF 32 | SF 33 | SF 34 | SF 35 | SF 36 | SF 37 | SF 38 | SF 4 | |
|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | 0 |
| | 8N-6 | ● | | | | | | | | | | | | | | | | | | | | | | 0 |
| | 8N-5 | ● | | | | | | | | | | | | | | | | | | | | | | 0 |
| | 8N-4 | ● | | | | | | | | | | | | | | | | | | | | | | 0 |
| | 8N-3 | ● | | | | | | | | | | | | | | | | | | | | | | 0 |
| | 8N-2 | ● | | | | | | | | | | | | | | | | | | | | | | 0 |
| | 8N-1 | ● | | | | | | | | | | | | | | | | | | | | | | 0 |
| | 8N | ● | | | | | | | | | | | | | | | | | | | | | | 0 |
| 0 1 0 0 | 8N-7 | | ⊙ | | | | | | | | | | | | | | | | | | | | | 1 |
| | 8N-6 | | ○ | ○ | ⊙ | | | | | | | | | | | | | | | | | | | 3 |
| | 8N-5 | | ○ | ⊙ | | | | | | | | | | | | | | | | | | | | 2 |
| | 8N-4 | | ○ | ○ | ○ | ⊙ | | | | | | | | | | | | | | | | | | 4 |
| | 8N-3 | | ○ | ○ | ⊙ | | | | | | | | | | | | | | | | | | | 3 |
| | 8N-2 | | ⊙ | | | | | | | | | | | | | | | | | | | | | 1 |
| | 8N-1 | | ○ | ○ | ○ | ⊙ | | | | | | | | | | | | | | | | | | 4 |
| | 8N | | ○ | ⊙ | | | | | | | | | | | | | | | | | | | | 2 |
| 0 0 1 0 | 8N-7 | | ○ | ○ | ○ | ○ | ⊙ | | | | | | | | | | | | | | | | | 5 |
| | 8N-6 | | ○ | ○ | ○ | ○ | ○ | ○ | ○ | ○ | ○ | ⊙ | | | | | | | | | | | | 10 |
| | 8N-5 | | ○ | ○ | ○ | ○ | ○ | ○ | ⊙ | | | | | | | | | | | | | | | 7 |
| | 8N-4 | | ○ | ○ | ○ | ○ | ○ | ○ | ○ | ○ | ○ | ○ | ○ | ⊙ | | | | | | | | | | 12 |
| | 8N-3 | | ○ | ○ | ○ | ○ | ○ | ○ | ○ | ○ | ⊙ | | | | | | | | | | | | | 9 |
| | 8N-2 | | ○ | ○ | ○ | ○ | ○ | ⊙ | | | | | | | | | | | | | | | | 6 |
| | 8N-1 | | ○ | ○ | ○ | ○ | ○ | ○ | ○ | ○ | ○ | ○ | ⊙ | | | | | | | | | | | 11 |
| | 8N | | ○ | ○ | ○ | ○ | ○ | ○ | ○ | ⊙ | | | | | | | | | | | | | | 8 |
| 0 0 0 1 | 8N-7 | | ○ | ○ | ○ | ○ | ○ | ○ | ○ | ○ | ○ | ○ | ○ | ○ | ⊙ | | | | | | | | | 13 |
| | 8N-6 | | ○ | ○ | ○ | ○ | ○ | ○ | ○ | ○ | ○ | ○ | ○ | ○ | ○ | ○ | ○ | ○ | ○ | ⊙ | | | | 18 |
| | 8N-5 | | ○ | ○ | ○ | ○ | ○ | ○ | ○ | ○ | ○ | ○ | ○ | ○ | ○ | ○ | ⊙ | | | | | | | 15 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ⊙ | | 20 |
| | 8N-3 | | ○ | ○ | ○ | ○ | ○ | ○ | ○ | ○ | ○ | ○ | ○ | ○ | ○ | ○ | ○ | ○ | ⊙ | | | | | 17 |
| | 8N-2 | | ○ | ○ | ○ | ○ | ○ | ○ | ○ | ○ | ○ | ○ | ○ | ○ | ○ | ⊙ | | | | | | | | 14 |
| | 8N-1 | | ○ | ○ | ○ | ○ | ○ | ○ | ○ | ○ | ○ | ○ | ○ | ○ | ○ | ○ | ○ | ○ | ○ | ○ | ⊙ | | | 19 |
| | 8N | | ○ | ○ | ○ | ○ | ○ | ○ | ○ | ○ | ○ | ○ | ○ | ○ | ○ | ○ | ○ | ⊙ | | | | | | 16 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | 21 |

FIG.29

| DATA CONVERSION TABLE | MD 0 1 2 | GD 0 1 2 3 | DISPLAY LINE | SF 4 | LIGHT EMISSION PATTERN SF 31 | SF 32 | SF 33 | SF 34 | SF 35 | SF 36 | SF 37 | SF 38 | SF 21 | SF 22 | SF 23 | SF 24 | SF 25 | SF 26 | SF 27 | SF 28 | SF 11 | SF 12 | SF 13 | SF 14 | LUMINANCE |
|---|---|---|---|---|---|---|---|---|---|---|---|---|---|---|---|---|---|---|---|---|---|---|---|---|---|
| FIFTH GRAYSCALE DRIVING | 1 0 0 | 1 0 0 0 | 8N-7 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N-6 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N-5 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N-4 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N-3 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N-2 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N-1 | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| | | | 8N | ◎ | ○ | ○ | ○ | ○ | ○ | ○ | ○ | ○ | ○ | ○ | ○ | ○ | ○ | ○ | ○ | ○ | ○ | ○ | ○ | ○ | 21 |
| FOURTH GRAYSCALE DRIVING | 0 1 1 | 0 1 0 0 | 8N-7 | | ◎ | ○ | ○ | ○ | ○ | ○ | ○ | ○ | ○ | ○ | ○ | ○ | ○ | ○ | ○ | ○ | ○ | ○ | ○ | ○ | 20 |
| | | | 8N-6 | | | | | ◎ | ○ | ○ | ○ | ○ | ○ | ○ | ○ | ○ | ○ | ○ | ○ | ○ | ○ | ○ | ○ | ○ | 17 |
| | | | 8N-5 | | | | | | | | ◎ | ○ | ○ | ○ | ○ | ○ | ○ | ○ | ○ | ○ | ○ | ○ | ○ | ○ | 14 |
| | | | 8N-4 | | | ◎ | ○ | ○ | ○ | ○ | ○ | ○ | ○ | ○ | ○ | ○ | ○ | ○ | ○ | ○ | ○ | ○ | ○ | ○ | 19 |
| | | | 8N-3 | | | | | | ◎ | ○ | ○ | ○ | ○ | ○ | ○ | ○ | ○ | ○ | ○ | ○ | ○ | ○ | ○ | ○ | 16 |
| | | | 8N-2 | | | | | | | | | ◎ | ○ | ○ | ○ | ○ | ○ | ○ | ○ | ○ | ○ | ○ | ○ | ○ | 13 |
| | | | 8N-1 | | | | ◎ | ○ | ○ | ○ | ○ | ○ | ○ | ○ | ○ | ○ | ○ | ○ | ○ | ○ | ○ | ○ | ○ | ○ | 18 |
| | | | 8N | | | | | | | ◎ | ○ | ○ | ○ | ○ | ○ | ○ | ○ | ○ | ○ | ○ | ○ | ○ | ○ | ○ | 15 |
| THIRD GRAYSCALE DRIVING | 0 1 0 | 0 0 1 0 | 8N-7 | | | | | | | | | | ◎ | ○ | ○ | ○ | ○ | ○ | ○ | ○ | ○ | ○ | ○ | ○ | 12 |
| | | | 8N-6 | | | | | | | | | | | | | ◎ | ○ | ○ | ○ | ○ | ○ | ○ | ○ | ○ | 9 |
| | | | 8N-5 | | | | | | | | | | | | | | | | ◎ | ○ | ○ | ○ | ○ | ○ | 6 |
| | | | 8N-4 | | | | | | | | | | | ◎ | ○ | ○ | ○ | ○ | ○ | ○ | ○ | ○ | ○ | ○ | 11 |
| | | | 8N-3 | | | | | | | | | | | | | | ◎ | ○ | ○ | ○ | ○ | ○ | ○ | ○ | 8 |
| | | | 8N-2 | | | | | | | | | | | | | | | | | ◎ | ○ | ○ | ○ | ○ | 5 |
| | | | 8N-1 | | | | | | | | | | | | ◎ | ○ | ○ | ○ | ○ | ○ | ○ | ○ | ○ | ○ | 10 |
| | | | 8N | | | | | | | | | | | | | | | ◎ | ○ | ○ | ○ | ○ | ○ | ○ | 7 |
| SECOND GRAYSCALE DRIVING | 0 0 1 | 0 0 0 1 | 8N-7 | | | | | | | | | | | | | | | | | | ◎ | ○ | ○ | ○ | 4 |
| | | | 8N-6 | | | | | | | | | | | | | | | | | | | ◎ | ○ | ○ | 3 |
| | | | 8N-5 | | | | | | | | | | | | | | | | | | | | | ◎ | 1 |
| | | | 8N-4 | | | | | | | | | | | | | | | | | | ◎ | ○ | ○ | ○ | 4 |
| | | | 8N-3 | | | | | | | | | | | | | | | | | | | | ◎ | ○ | 2 |
| | | | 8N-2 | | | | | | | | | | | | | | | | | | | | | ◎ | 1 |
| | | | 8N-1 | | | | | | | | | | | | | | | | | | | ◎ | ○ | ○ | 3 |
| | | | 8N | | | | | | | | | | | | | | | | | | | | ◎ | ○ | 2 |
| FIRST GRAYSCALE DRIVING | 0 0 0 | 0 0 0 0 | 8N-7 | | | | | | | | | | | | | | | | | | | | | | 0 |
| | | | 8N-6 | | | | | | | | | | | | | | | | | | | | | | 0 |
| | | | 8N-5 | | | | | | | | | | | | | | | | | | | | | | 0 |
| | | | 8N-4 | | | | | | | | | | | | | | | | | | | | | | 0 |
| | | | 8N-3 | | | | | | | | | | | | | | | | | | | | | | 0 |
| | | | 8N-2 | | | | | | | | | | | | | | | | | | | | | | 0 |
| | | | 8N-1 | | | | | | | | | | | | | | | | | | | | | | 0 |
| | | | 8N | | | | | | | | | | | | | | | | | | | | | | 0 |

DISPLAY PANEL DRIVING METHOD

BACKGROUND OF THE INVENTION

Field of the Invention

The present invention relates to a driving method for a display panel in which pixel cells serving as pixels are arranged on respective display lines.

Recently, where two-dimensional image display panels are concerned, plasma display panels (hereinafter called 'PDP'), in which a plurality of discharge cells are arranged in the form of a matrix, have been attracting attention. The subfield method is known as a driving method for displaying an image corresponding with a video input signal on the PDP. The subfield method divides a single-field display period into a plurality of subfields and causes each of the discharge cells to selectively discharge light in each subfield in accordance with the luminance level represented by the video input signal. Accordingly, an intermediate luminance corresponding with the total light emission period within the single-field period is visible (or perceived).

FIG. 1 of the attached drawings shows an example of a light emission drive sequence based on this subfield method. This emission drive sequence is disclosed in, for example, Japanese Patent Application Kokai (Laid-Open Publication) No. 2000-227778.

The light emission drive sequence shown in FIG. 1 divides a single field period into 14 subfields, namely the subfields SF1 to SF14. All the discharge cells of the PDP are initialized in a lit mode only in the leading subfield SF1 of these subfields SF1 to SF14 (Rc). Each of the subfields SF1 to SF14 sets some of the discharge cells to an unlit mode in accordance with the video input signal (Wc) and causes only the discharge cells of lit mode to discharge light over the period allocated to the subfield concerned (Ic).

FIG. 2 of the attached drawings shows an example of a light emission drive pattern in a single field period of each discharge cell that is driven on the basis of this light emission drive sequence (see Japanese Patent Application Kokai No. 2000-2277785).

According to the light emission pattern shown in FIG. 2, the discharge cells initialized in the lit mode in the leading subfield SF1 are then set to the unlit mode in a particular one subfield of the subfields SF1 to SF14, as indicated by the black circles. Once the discharge cell is set to the unlit mode, the discharge cell does not re-enter the lit mode until the one field period ends. Accordingly, during the period until the discharge cells are set to the unlit mode, as indicated by the white circles, the discharge cells discharge light continuously in these subfields. Each of the fifteen different light emission patterns shown in FIG. 2 has a different total light emission period within a single field period, and hence fifteen different intermediate luminances are rendered. That is, an intermediate luminance display for (N+1) grayscales (N being the number of subfields) is feasible.

However, with this driving method, because there are restrictions on the number of subfields, there is a shortage in the number of grayscales. In order to compensate for the shortage in the number of grayscales, multiple grayscale processing such as error diffusion and dither processing is performed on the video input signal.

Error diffusion processing converts the video input signal into 8-bit pixel data, for example, for each pixel. The upper 6 bits of the pixel data is treated as display data and the remaining lower two bits of the pixel data is treated as error data. Then, the error data of the pixel data are weighted and added based on the respective peripheral pixels and the resultant is reflected in the display data. As a result of this operation, a pseudo-representation of the luminance of the lower two bits of the original pixel is provided by the peripheral pixels, and, consequently, a luminance grayscale representation of the 8 bits of pixel data is possible by means of the six bits of display data. Further, dither processing is performed on the six-bit error-diffusion-processed pixel data obtained by the error diffusion processing. In dither processing, a single pixel unit is rendered from a plurality of adjoining pixels, and dither coefficients consisting of different coefficient values are allocated and added to the error-diffusion-processed pixel data corresponding with the respective pixels in the single pixel unit. As a result of the addition of the dither coefficients, when viewed in the single pixel unit, the luminance of the 8-bit original data can be represented by only the upper four bits of the dither-added pixel data. Therefore, the upper four bits of the dither-added pixel data are extracted and allocated to each of the 15 different light emission patterns shown in FIG. 2 as multiple grayscale pixel data PDs.

However, when a dither coefficient addition is performed regularly on the pixel data by means of dither processing and so forth, a pseudo pattern which is completely independent of the video input signal, i.e. a so-called dither pattern, is sometimes observed, which compromises the quality of the displayed image.

SUMMARY OF THE INVENTION

An object of the present invention is to provide a display panel driving method capable of creating a favorable image display in which dither patterns are suppressed.

According to one aspect of the present invention, there is provided an improved method of grayscale-driving a display panel in accordance with pixel data derived from a video signal. The display panel includes a plurality of display lines, with a plurality of pixel cells serving as pixels being arranged on each display line. A display period of a single field of the video signal is divided into a plurality of subfields. The method includes dividing one of the subfields into M lower subfields. M is an integer greater than one. M groups of display lines are prepared by sequentially taking every M display lines from the display lines. First to Mth address steps are performed in the M lower subfields respectively and sequentially. Each address step sets the pixel cells belonging to the display lines of the display line group concerned, to a drive mode determined by the pixel data. A first light emission step is performed to cause the pixel cells whose drive mode is a lit mode, to emit light directly before or after the address step concerned. Another subfield is divided into N lower subfields. N is smaller than M. N groups of address steps are prepared from the first to Mth address steps. Each address step group includes one or more address steps, and at least one address step group includes a plurality of address steps. The N address step groups are performed in the N lower subfields respectively and sequentially. A second light emission step is performed to cause the pixel cells whose drive mode is the lit mode, to emit light directly before or after the address step group concerned.

These and other objects, aspects and advantages of the present invention will become apparent to those skilled in the art from the following detailed description and appended claims when read and understood in conjunction with the attached drawings.

BRIEF DESCRIPTION OF THE DRAWINGS

FIG. 2 shows an example of light emission drive patterns in a single field period of respective discharge cells driven on the basis of the light emission drive sequence shown in FIG. 1;

FIG. 5 shows a data conversion table used by a drive data conversion circuit shown in FIG. 3;

FIGS. 6A to 6H show light emission drive sequences in the first to eighth fields, respectively;

FIG. 7 illustrates light emission drive patterns based on the light emission drive sequence shown in FIG. 6A;

FIG. 8 illustrates light emission drive patterns based on the light emission drive sequence shown in FIG. 6B;

FIG. 9 illustrates light emission drive patterns based on the light emission drive sequence shown in FIG. 6C;

FIG. 10 illustrates light emission drive patterns based on the light emission drive sequence shown in FIG. 6D;

FIG. 11 illustrates light emission drive patterns based on the light emission drive sequence shown in FIG. 6E;

FIG. 12 illustrates light emission drive patterns based on the light emission drive sequence shown in FIG. 6F;

FIG. 13 illustrates light emission drive patterns based on the light emission drive sequence shown in FIG. 6G;

FIG. 14 illustrates light emission drive patterns based on the light emission drive sequence shown in FIG. 6H;

FIGS. 18A to 18H show light emission drive sequences in the first to eighth fields, respectively, according to an embodiment of the present invention;

FIG. 19 shows light emission drive patterns based on the light emission drive sequence shown in FIG. 18A;

FIG. 20 shows light emission drive patterns based on the light emission drive sequence shown in FIG. 18B;

FIG. 21 shows light emission drive patterns based on the light emission drive sequence shown in FIG. 18C;

FIG. 22 shows light emission drive patterns based on the light emission drive sequence shown in FIG. 18D;

FIG. 23 shows light emission drive patterns based on the light emission drive sequence shown in FIG. 18E;

FIG. 24 shows light emission drive patterns based on the light emission drive sequence shown in FIG. 18F;

FIG. 25 shows light emission drive patterns based on the light emission drive sequence shown in FIG. 18G;

FIG. 26 shows light emission drive patterns based on the light emission drive sequence shown in FIG. 18H;

FIG. 29 shows the light emission drive pattern based on the light emission drive sequence shown in FIG. 28.

DETAILED DESCRIPTION OF THE INVENTION

Figure 1:
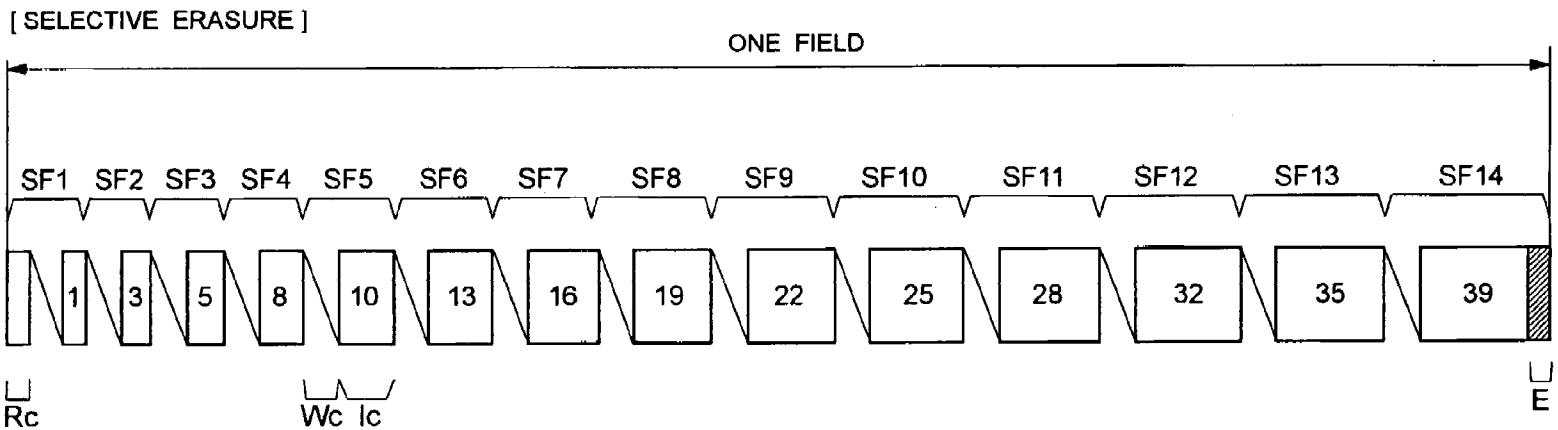
FIG. 1 shows an example of a light emission drive sequence based on the subfield method.

A description of a drive device for driving a plasma display panel (PDP) based on a driving method according to one embodiment of the present invention will now be provided with reference to FIG. 3 to FIG. 27.

The PDP 100 includes a front-side substrate (not shown) that functions as a display surface, and a rear-side substrate (not shown) that is disposed in a position opposite the front-side substrate. A discharge space filled with discharge gas is defined between the front-side substrate and rear-side substrate. Belt-shaped row electrodes $X_1$ to $X_n$ and row electrodes $Y_1$ to $Y_n$ are alternately arranged in parallel to each other and provided on the front-side substrate. Belt-shaped column electrodes $D_1$ to $D_m$ arranged to cross over the row electrodes are provided on the rear-side substrate. The row electrodes $X_1$ to $X_n$ and $Y_1$ to $Y_n$ are arranged such that the first to nth display lines of the PDP 100 are defined by n pairs of row electrodes $X_1$ and $Y_1$. Discharge cells G serving as pixels are formed at the intersection points (including the discharge space) between the row electrode pairs and column electrodes. That is, (n×m) discharge cells $G_{(1,1)}$ to $G_{(n,m)}$ are formed in a matrix shape on the PDP 100.

A pixel data conversion circuit 1 converts a video input signal into 6-bit pixel data PD, for example, for each pixel, and then supplies this pixel data PD to a multiple grayscale processing circuit 2. The multiple grayscale processing circuit 2 includes a line dither offset value generation circuit 21, an adder 22, and a lower bit discard circuit 23.

The line dither offset value generation circuit 21 first generates eight line dither offset values LD with the values '0' to '7' respectively to match eight display line groups of the PDP 100. The first to nth display lines of the PDP 100 are separated by eight lines and grouped as shown below:

the (8N-7)th display line group consisting of the 1st, 9th, 17th, . . . , (n-7)th display lines;

the (8N-6)th display line group consisting of the 2nd, 10th, 18th, . . . , and (n-6)th display lines;

the (8N-5)th display line group consisting of the 3rd, 11th, 19th, . . . , and (n-5)th display lines;

the (8N-4)th display line group consisting of the 4th, 12th, 20th, . . . , and (n-4)th display lines;

the (8N-3)th display line group consisting of the 5th, 13th, 21st, . . . , and (n-3)th display lines;

the (8N-2)th display line group consisting of the 6th, 14th, 22nd, . . . , and (n-2)th display lines;

the (8N-1)th display line group consisting of the 7th, 15th, 23rd, . . . , and (n-1)th display lines; and the (8N)th display line group consisting of the 8th, 16th, 24th, . . . , and nth display lines.

Here, N is a natural number equal to or less than (1/8)·n.

The line dither offset value generation circuit 21 repeatedly executes, for each field and with 8 fields forming one cycle, the alteration of allocation of the line dither offset values LD to the display line groups, as shown in FIGS. 4A to 4H.

Figures 4A, 4B, 4C, 4D, 4E, 4F, 4G, 4H:
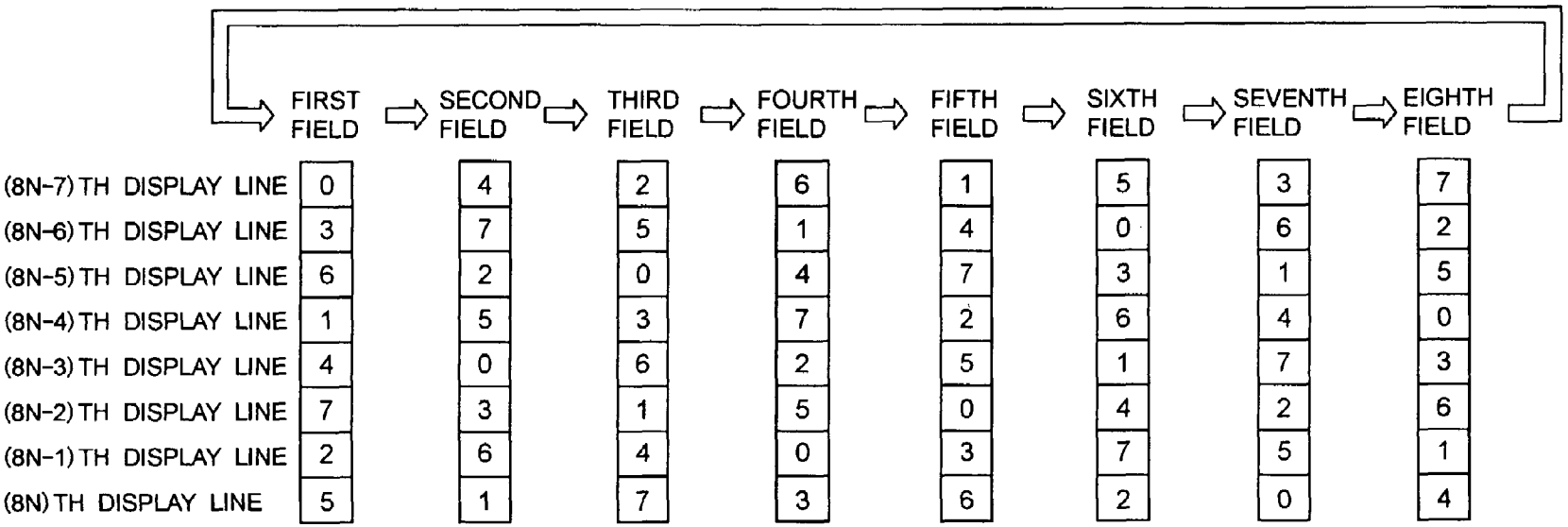
FIGS. 4A to 4H show allocation of line dither offset values to first to eighth fields, respectively.

Specifically, as shown in FIG. 4A, the line dither offset value generation circuit 21 allocates, in the very first field, the following line dither offset values LD to the eight display line groups:

'0' for the (8N-7)th display line group,

'3' for the (8N-6)th display line group,

'6' for the (8N-5)th display line group,

'1' for the (8N-4)th display line group,
'4' for the (8N-3)th display line group,
'7' for the (8N-2)th display line group,
'2' for the (8N-1)th display line group, and
'5' for the (8N)th display line group.

As shown in FIG. 4B, the line dither offset values LD with the following values are allocated in the second field:

'4' for the (8N-7)th display line group;
'7' for the (8N-6)th display line group;
'2' for the (8N-5)th display line group;
'5' for the (8N-4)th display line group;
'0' for the (8N-3)th display line group;
'3' for the (8N-2)th display line group;
'6' for the (8N-1)th display line group; and
'1' for the (8N)th display line group.

As shown in FIG. 4C, the line dither offset values LD with the following values are allocated in the third field:

'2' for the (8N-7)th display line group;
'5' for the (8N-6)th display line group;
'0' for the (8N-5)th display line group;
'3' for the (8N-4)th display line group;
'6' for the (8N-3)th display line group;
'1' for the (8N-2)th display line group;
'4' for the (8N-1)th display line group; and
'7' for the (8N)th display line group.

As shown in FIG. 4D, the line dither offset values LD with the following values are allocated in the fourth field:

'6' for the (8N-7)th display line group;
'1' for the (8N-6)th display line group;
'4' for the (8N-5)th display line group;
'7' for the (8N-4)th display line group;
'2' for the (8N-3)th display line group;
'5' for the (8N-2)th display line group;
'0' for the (8N-1)th display line group; and
'3' for the (8N)th display line group.

As shown in FIG. 4E, the line dither offset values LD with the following values are allocated in the fifth field:

'1' for the (8N-7)th display line group;
'4' for the (8N-6)th display line group;
'7' for the (8N-5)th display line group;
'2' for the (8N-4)th display line group;
'5' for the (8N-3)th display line group;
'0' for the (8N-2)th display line group;
'3' for the (8N-1)th display line group; and
'6' for the (8N)th display line group.

As shown in FIG. 4F, the line dither offset values LD with the following values are allocated in the sixth field:

'5' for the (8N-7)th display line group;
'0' for the (8N-6)th display line group;
'3' for the (8N-5)th display line group;
'6' for the (8N-4)th display line group;
'1' for the (8N-3)th display line group;
'4' for the (8N-2)th display line group;
'7' for the (8N-1)th display line group; and
'2' for the (8N)th display line group.

As shown in FIG. 4G, the line dither offset values LD with the following values are allocated in the seventh field:

'3' for the (8N-7)th display line group;
'6' for the (8N-6)th display line group;
'1' for the (8N-5)th display line group;
'4' for the (8N-4)th display line group;
'7' for the (8N-3)th display line group;
'2' for the (8N-2)th display line group;
'5' for the (8N-1)th display line group; and
'0' for the (8N)th display line group.

As shown in FIG. 4H, the line dither offset values LD with the following values are allocated in the eighth field:

'7' for the (8N-7)th display line group;
'2' for the (8N-6)th display line group;
'5' for the (8N-5)th display line group;
'0' for the (8N-4)th display line group;
'3' for the (8N-3)th display line group;
'6' for the (8N-2)th display line group;
'1' for the (8N-1)th display line group; and
'4' for the (8N)th display line group.

The line dither offset value generation circuit 21 provides the adder 22 with the line dither offset values LD allocated to the display lines belonging to discharge cells corresponding with pixel data PD supplied by the pixel data conversion circuit 1.

The adder 22 provides the lower bit discard circuit 23 with line-offset-added pixel data LF, which is prepared by adding the line dither offset values LD to pixel data PD supplied by the pixel data conversion circuit 1. The lower bit discard circuit 23 discards the lower three bits of the line-offset-added pixel data LF and then supplies the remaining three upper bits of this data LF to the drive data conversion circuit 3 as multiple grayscale pixel data MD.

A drive data conversion circuit 3 converts multiple grayscale pixel data MD into 4-bit pixel drive data GD in accordance with a data conversion table shown in FIG. 5 and supplies the four-bit pixel drive data GD to a memory 4.

The memory 4 sequentially captures and stores the 4-bit pixel drive data GD. Each time the memory 4 finishes the writing of one image-frame (n rows×m columns) of pixel drive data $GD_{1,1}$ to $GD_{n,m}$, the memory 4 divides the pixel drive data $GD_{1,1}$ to $GD_{n,m}$ into bit digits (0th to 3rd bits) and reads one display line's worth of this data at a time in correspondence with the subfields SF0 to SF3 respectively. The memory 4 supplies m pixel drive data bits corresponding to one display line to a column electrode driver circuit 5 as the pixel drive data bits DB1 to DBm.

That is, in the subfield SF0, the memory 4 reads only the 0th bit of each of the pixel drive data $GD_{1,1}$ to $GD_{n,m}$ one display line at a time, and supplies the respective 0th bits to the column electrode driver circuit 5 as the pixel drive data bits DB1 to DBm. In the next subfield (i.e., subfield SF1), the memory 4 reads, one display line at a time, only the respective first bits of pixel drive data $GD_{1,1}$ to $GD_{n,m}$ and supplies these first bits to the column electrode driver circuit 5 as the pixel drive data bits DB1 to DBm. Next, in the subfield SF2, the memory 4 reads only the respective second bits of the pixel drive data $GD_{1,1}$ to $GD_{n,m}$ one display line at a time and supplies these second bits to the column electrode driver circuit 5 as pixel drive data bits DB1 to DBm. Subsequently, in the subfield SF3, the memory 4 reads only the respective third bits of the pixel drive data $GD_{1,1}$ to $GD_{n,m}$ one display line at a time and supplies these third bits to the column electrode driver circuit 5 as pixel drive data bits DB1 to DBm.

Figures 6A, 6B, 6C, 6D:
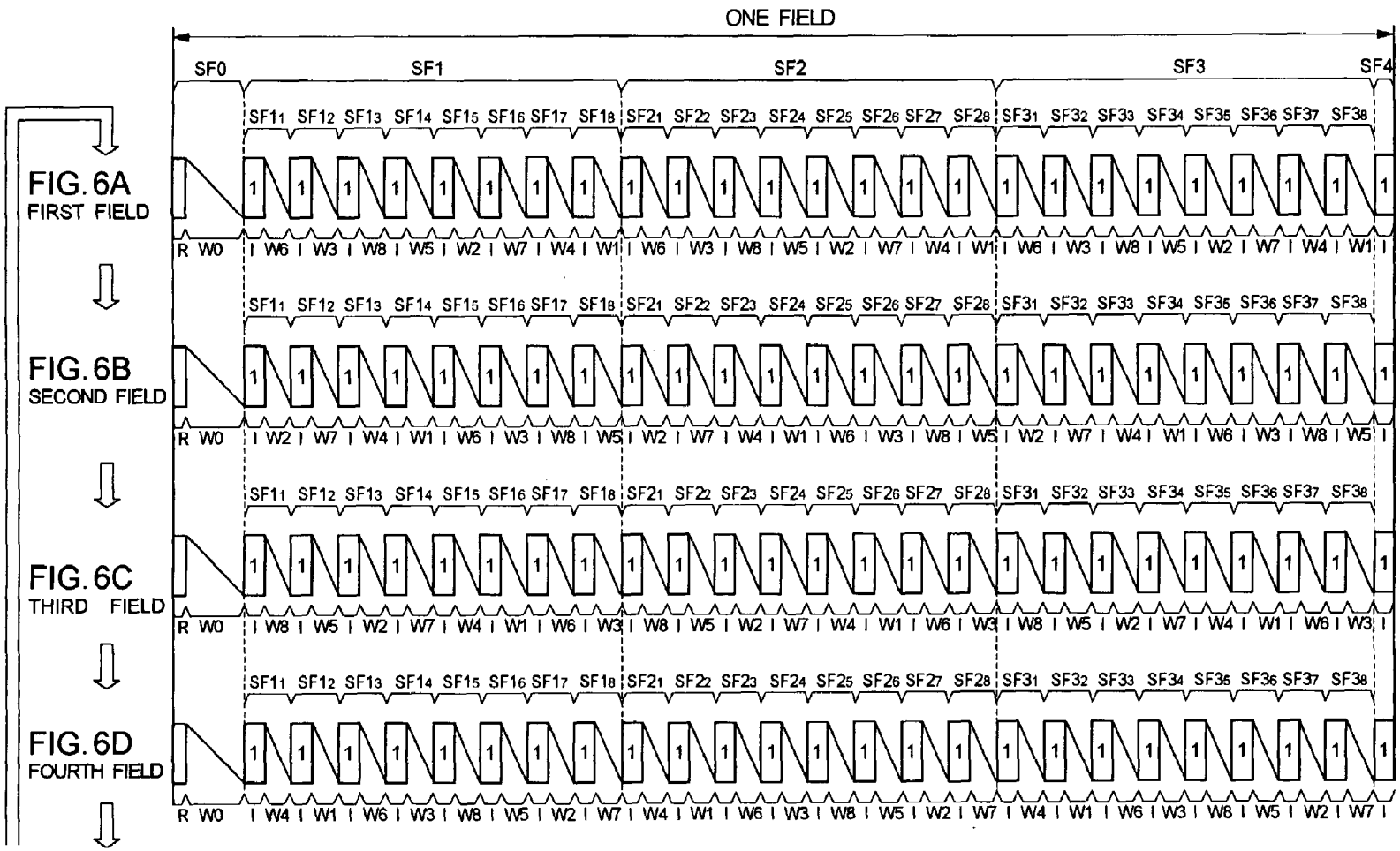

A drive control circuit 6 generates various timing signals for grayscale-driving the PDP 100 in accordance with the light emission drive sequences shown in the following drawings:

first subfield: the drive sequence shown in FIG. 6A;
second subfield: the drive sequence shown in FIG. 6B;
third subfield: the drive sequence shown in FIG. 6C;
fourth subfield: the drive sequence shown in FIG. 6D;
fifth subfield: the drive sequence shown in FIG. 6E;
sixth subfield: the drive sequence shown in FIG. 6F;
seventh subfield: the drive sequence shown in FIG. 6G; and
eighth subfield: the drive sequence shown in FIG. 6H.

The drive control circuit 6 supplies these timing signals to the column electrode driver circuit 5, the row electrode Y driver circuit 7 and the row electrode X driver circuit 8 respectively. A series of driving shown in FIGS. 6A to 6H is executed repeatedly.

The column electrode driver circuit 5, the row electrode Y driver circuit 7, and the row electrode X driver circuit 8 generate various drive pulses (not shown) to drive the PDP 100 as described below in accordance with the timing signals supplied by the drive control circuit 6, and apply these drive pulses to the column electrodes $D_1$ to $D_m$, row electrodes $X_1$ to $X_n$, and row electrodes $Y_1$ to $Y_n$ of the PDP 100, respectively.

It should be noted that in the light emission drive sequence shown in FIGS. 6A to 6H, each of the fields of the video input signal is constituted by the five subfields SF0 to SF4.

The leading subfield SF0 sequentially executes a reset step R and an address step W0. The reset step R causes all the discharge cells $G_{(1,1)}$ to $G_{(n,m)}$ of the PDP 100 to perform a reset discharge all together and initializes the discharge cells $G_{(1,1)}$ to $G_{(n,m)}$ in a lit mode (state in which a wall charge of a predetermined amount is formed). In the address step W0, the discharge cells G arranged on the first to nth display lines of the PDP 100 are selectively made to perform an erase discharge in accordance with the pixel drive data GD as shown in FIG. 5, in sequence one display line at a time, so that the selected discharge cells are brought into an unlit mode (state where the wall charge has been erased or extinguished). The discharge cells in which the erasure discharge is not induced in this address step W0 retain the state up until immediately before this address step W0, that is, the lit mode.

Each of the subfields SF1 to SF3 is further divided into eight subfields $SF1_1$, to $SF1_8$, $SF2_1$ to $SF2_8$, and $SF3_1$ to $SF3_8$ respectively. Address steps W1 to W8 are executed in the subfields $SF1_1$, to $SF1_8$, $SF2_1$ to $SF2_8$, and $SF3_1$ to $SF3_8$ respectively.

In the address step W1, only discharge cells that are arranged in the (8N-7)th display lines (i.e., the 1st, 9th, 17th, . . . , and (n-7)th display lines) among all the discharge cells $G_{(1,1)}$ to $G_{(n,m)}$ in the PDP 100, are selectively caused to perform an erasure discharge in accordance with the pixel drive data. As a result, discharge cells in which an erasure discharge is induced are set to the unlit mode, and discharge cells in which an erasure discharge is not induced retain the state up until immediately before the address step W1. That is, the address step W1 sets the discharge cells arranged on the (8N-7)th display lines to either the unlit or lit mode in accordance with the pixel drive data.

In the address step W2, only the discharge cells arranged on the (8N-6)th display lines (i.e., the 2nd, 10th, 18th, . . . , and (n-6)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until immediately before the address step W2. That is, the address step W2 sets the discharge cells arranged on the (8N-6)th display lines to either the unlit mode or the lit mode in accordance with the pixel drive data.

In the address step W3, only discharge cells arranged on the (8N-5)th display lines (i.e., the 3rd, 11th, 19th, . . . , and (n-5)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until directly before the address step W3. That is, the address step W3 sets the discharge cells arranged on the (8N-5)th display lines to either the unlit or lit mode in accordance with the pixel drive data.

In the address step W4, only discharge cells arranged on the (8N-4)th display lines (i.e., the 4th, 12th, 20th, . . . , and (n-4)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until directly before the address step W4. That is, the address step W4 sets the discharge cells arranged on the (8N-4)th display lines to either the unlit or lit mode in accordance with the pixel drive data.

In the address step W5, only discharge cells arranged on the (8N-3)th display lines (i.e., the 5th, 13th, 21st, . . . , and (n-3)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until directly before the address step W5. That is, the address step W5 sets the discharge cells arranged on the (8N-3)th display lines to either the unlit or lit mode in accordance with the pixel drive data.

In the address step W6, only discharge cells arranged on the (8N-2)th display lines (i.e., the 6th, 14th, 22nd, . . . , and (n-2)th display lines) are selectively made to perform an erasure discharge in accordance with the pixel drive data. As result, discharge cells in which an erasure discharge is induced are set to the unlit mode, and discharge cells in which an erasure discharge is not induced retain the state up until directly before the address step W6. That is, the address, step W6 sets the discharge cells arranged on the (8N-2)th display lines to either the unlit or lit mode in accordance with the pixel drive data.

In the address step W7, only discharge cells arranged on the (8N-1)th display lines (i.e., the 7th, 15th, 23rd, . . . , and (n-1)th display lines) are selectively made to perform an erasure discharge in accordance with the pixel drive data. Discharge cells in which an erasure discharge is induced are set to the unlit mode, and discharge cells in which an erasure discharge is not induced retain the state up until directly before the address step W7. That is, the address step W7 sets the discharge cells arranged on the (8N-1)th display lines to either the unlit or lit mode in accordance with the pixel drive data.

In the address step W8, only discharge cells arranged on the (8N)th display lines (i.e., the 8th, 16th, 24th, . . . , and nth display lines) are selectively made to perform an erasure discharge in accordance with the pixel drive data. Discharge cells in which an erasure discharge is induced are set to the unlit mode, and discharge cells in which an erasure discharge is not induced retain the state up until directly before the address step W8. That is, the address step W8 sets the discharge cells arranged on the (8N)th display lines to either the unlit or lit mode in accordance with the pixel drive data.

In the light emission drive sequence shown in FIG. 6A, the following address steps are executed in the subfields:

the address step W6 in the subfields $SF1_1$, $SF2_1$, $SF3_1$ respectively;

the address step W3 in the subfields $SF1_2$, $SF2_2$, $SF3_2$ respectively;

the address step W8 in the subfields $SF1_3$, $SF2_3$, $SF3_3$ respectively;

the address step W5 in the subfields $SF1_4$, $SF2_4$, $SF3_4$ respectively;

the address step W2 in the subfields $SF1_5$, $SF2_5$, $SF3_5$ respectively;

the address step W7 in the subfields $SF1_6$, $SF2_6$g $SF3_6$ respectively;

the address step W4 in the subfields $SF1_7$, $SF2_7$, $SF3_7$ respectively; and the address step W1 in the subfields $SF1_8$, $SF2_8$, $SF3_8$ respectively.

In the light emission drive sequence shown in FIG. 6B, the following address steps are executed in the subfields:

the address step W2 in the subfields $SF1_1$, $SF2_1$, $SF3_1$ respectively;

the address step W7 in the subfields $SF1_2$, $SF2_2$, $SF3_2$ respectively;

the address step W4 in the subfields $SF1_3$, $SF2_3$, $SF3_3$ respectively;

the address step W1 in the subfields $SF1_4$, $SF2_4$, $SF3_4$ respectively;

the address step W6 in the subfields $SF1_{51}$ $SF2_5$, $SF3_5$ respectively;

the address step W3 in the subfields $SF1_6$, $SF2_6$, $SF3_6$ respectively;

the address step W8 in the subfields $SF1_7$, $SF2_7$, $SF3_7$ respectively; and the address step W5 in the subfields $SF1_8$, $SF2_8$, $SF3_8$ respectively.

In the light emission drive sequence shown in FIG. 6C, the following address steps are executed in the subfields:

the address step W8 in the subfields $SF1_1$, $SF2_1$, $SF3_1$ respectively;

the address step W5 in the subfields $SF1_2$, $SF2_2$, $SF3_2$ respectively;

the address step W2 in the subfields $SF1_3$, $SF2_3$, $SF3_3$ respectively;

the address step W7 in the subfields $SF1_4$, $SF2_4$, $SF3_4$ respectively;

the address step W4 in the subfields $SF1_5$, $SF2_5$, $SF3_5$ respectively;

the address step W1 in the subfields $SF1_6$, $SF2_6$, $SF3_6$ respectively;

the address step W6 in the subfields $SF1_7$, $SF2_7$, $SF3_7$ respectively; and the address step W3 in the subfields $SF1_8$, $SF2_8$, $SF3_8$ respectively.

In the light emission drive sequence shown in FIG. 6D, the following address steps are executed in the subfields:

the address step W4 in the subfields $SF1_1$, $SF2_1$, $SF3_1$ respectively;

the address step W1 in the subfields $SF1_2$, $SF2_2$, $SF3_2$ respectively;

the address step W6 in the subfields $SF1_3$, $SF2_3$, $SF3_3$ respectively;

the address step W3 in the subfields $SF1_4$, $SF2_4$, $SF3_4$ respectively;

the address step W8 in the subfields $SF1_5$, $SF2_5$, $SF3_5$ respectively;

the address step W5 in the subfields $SF1_6$, $SF2_6$, $SF3_6$ respectively;

the address step W2 in the subfields $SF1_7$, $SF2_7$, $SF3_7$ respectively; and the address step W7 in the subfields $SF1_8$, $SF2_8$, $SF3_8$ respectively.

In the light emission drive sequence shown in FIG. 6E, the following address steps are executed in the subfields:

the address step W3 in the subfields $SF1_1$, $SF2_1$, $SF3_1$ respectively;

the address step W8 in the subfields $SF1_2$, $SF2_2$, $SF3_2$ respectively;

the address step W5 in the subfields $SF1_3$, $SF2_3$, $SF3_3$ respectively;

the address step W2 in the subfields $SF1_4$, $SF2_4$, $SF3_4$ respectively;

the address step W7 in the subfields $SF1_5$, $SF2_5$, $SF3_5$ respectively;

the address step W4 in the subfields $SF1_6$, $SF2_6$, $SF3_6$ respectively;

the address step W1 in the subfields $SF1_7$, $SF2_7$, $SF3_7$ respectively; and the address step W6 in the subfields $SF1_8$, $SF2_8$, $SF3_8$ respectively.

In the light emission drive sequence shown in FIG. 6F, the following address steps are executed in the subfields:

the address step W7 in the subfields $SF1_1$, $SF2_1$, $SF3_1$ respectively;

the address step W4 in the subfields $SF1_2$, $SF2_2$, $SF3_2$ respectively;

the address step W1 in the subfields $SF1_3$, $SF2_3$, $SF3_3$ respectively;

the address step W6 in the subfields $SF1_4$, $SF2_4$, $SF3_4$ respectively;

the address step W3 in the subfields $SF1_5$, $SF2_5$, $SF3_5$ respectively;

the address step W8 in the subfields $SF1_6$, $SF2_6$, $SF3_6$ respectively;

the address step W5 in the subfields $SF1_7$, $SF2_7$, $SF3_7$ respectively; and the address step W2 in the subfields $SF1_8$, $SF2_8$, $SF3_8$ respectively.

In the light emission drive sequence shown in FIG. 6G, the following address steps are executed in the subfields:

the address step W5 in the subfields $SF1_1$, $SF2_1$, $SF3_1$ respectively;

the address step W2 in the subfields $SF1_2$, $SF2_2$, $SF3_2$ respectively;

the address step W7 in the subfields $SF1_3$, $SF2_3$, $SF3_3$ respectively;

the address step W4 in the subfields $SF1_4$, $SF2_4$, $SF3_4$ respectively;

the address step W1 in the subfields $SF1_5$, $SF2_5$, $SF3_5$ respectively;

the address step W6 in the subfields $SF1_6$, $SF2_6$, $SF3_6$ respectively;

the address step W3 in the subfields $SF1_7$, $SF2_7$, $SF3_7$ respectively; and the address step W8 in the subfields $SF1_8$, $SF2_8$, $SF3_8$ respectively.

Further, in the light emission drive sequence shown in FIG. 6H, the following address steps are executed in the subfields:

the address step W1 in the subfields $SF1_1$, $SF2_1$, $SF3_1$ respectively;

the address step W6 in the subfields $SF1_2$, $SF2_2$, $SF3_2$ respectively;

the address step W3 in the subfields $SF1_3$, $SF2_3$, $SF3_3$ respectively;

the address step W8 in the subfields $SF1_4$, $SF2_4$, $SF3_4$ respectively;

the address step W5 in the subfields $SF1_5$, $SF2_5$, $SF3_5$ respectively;

the address step W2 in the subfields $SF1_6$, $SF2_6$, $SF3_6$ respectively;

the address step W7 in the subfields $SF1_7$, $SF2_7$, $SF3_7$ respectively; and the address step W4 in the subfields $SF1_8$, $SF2_8$, $SF3_8$ respectively.

In each of the subfields $SF1_1$to $SF1_8$, $SF2_1$to $SF2_8$, and $SF3_1$ to $SF3_8$, directly before the respective address steps W1 to W8, a sustain step I, which causes only the discharge cells set to the lit mode to discharge light continuously over the period '1', is executed.

In the final subfield SF4, only the sustain step I, which causes the discharge cells set to the lit mode to discharge light continuously over the period '1', is executed.

The drive control circuit 6 performs light emission driving as shown in FIGS. 7 to 14 in accordance with the light emission drive sequences shown in FIGS. 6A to 6H.

FIG. 7 shows light emission drive patterns based on the light emission drive sequence in FIG. 6A;

FIG. 8 shows light emission drive patterns based on the light emission drive sequence in FIG. 6B;

FIG. 9 shows light emission drive patterns based on the light emission drive sequence in FIG. 6C;

FIG. 10 shows light emission drive patterns based on the light emission drive sequence in FIG. 6D;

FIG. 11 shows light emission drive patterns based on the light emission drive sequence in FIG. 6E;

FIG. 12 shows light emission drive patterns based on the light emission drive sequence in FIG. 6F;

FIG. 13 shows light emission drive patterns based on the light emission drive sequence in FIG. 6G; and FIG. 14 shows light emission drive patterns based on the light emission drive sequence in FIG. 6H.

When '1000' pixel drive data GD, which represents the lowest luminance, is supplied, a light emission display based on first grayscale driving is executed. Because the 0th bit of the pixel drive data GD is logic level 1, an erasure discharge (indicated by the black circles) is induced in the discharge cells in the address step W0 of the subfield SF0, and the discharge cells become the unlit mode. According to the driving scheme shown in FIGS. 6A to 6H, the opportunity, in a single field display period, for discharge cells to shift from the unlit mode to the lit mode arises only in the reset step R of the leading subfield SF0. Accordingly, discharge cells that have become the unlit mode retain the unlit state in the course of the single field display period.

Figure 15:
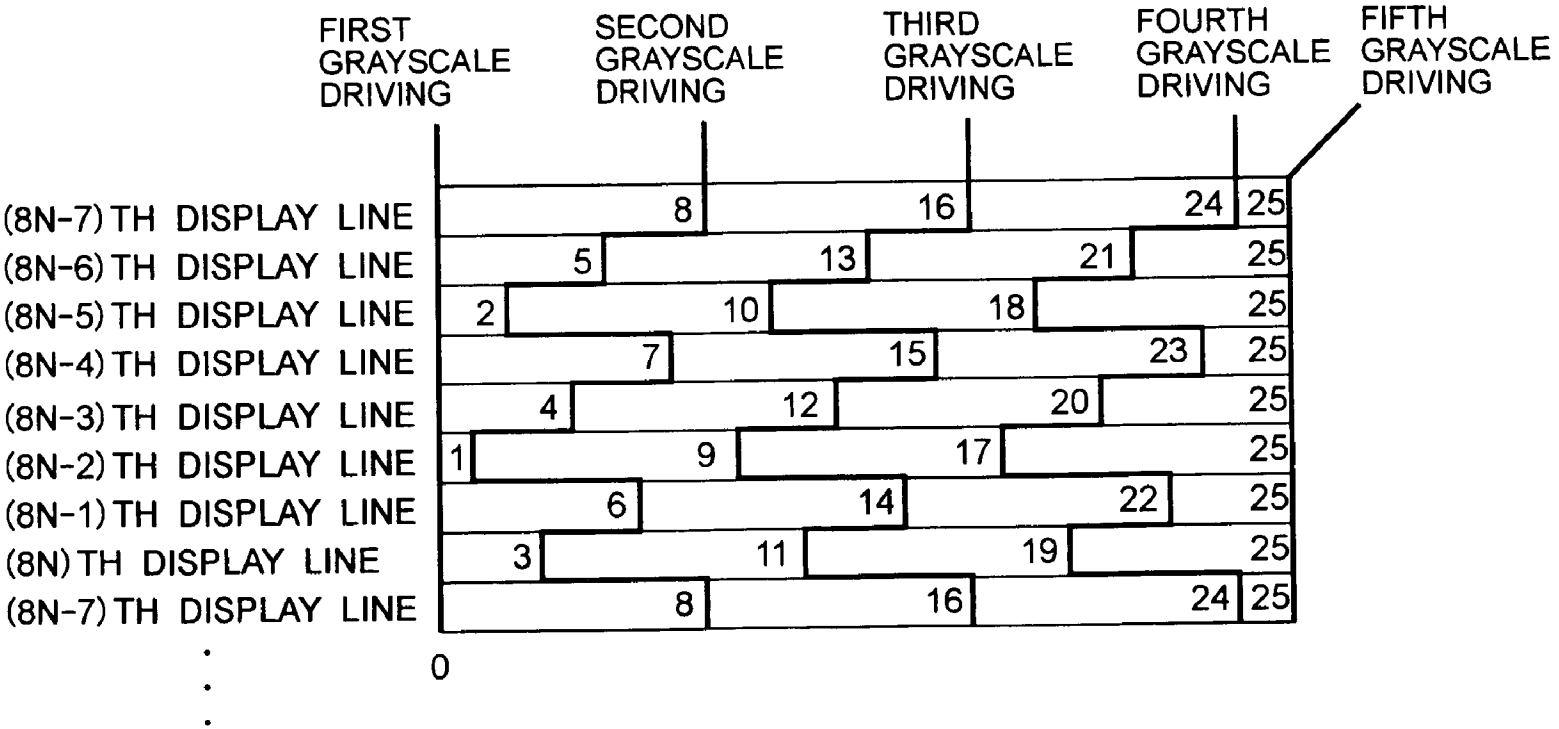
FIG. 15 is a diagram which depicts, for each display line, luminance levels of the first to fifth grayscale driving respectively.

In other words, in the first grayscale driving in accordance with the '1000' pixel drive data GD, each discharge cell retains the unlit state in the course of a single field display period, thereby achieving the luminance level (brightness level) 0 as shown in FIG. 15.

When '0100' pixel drive data GD representing a luminance one level higher than that of the '1000' pixel drive data is supplied, a light emission display based on second grayscale driving is implemented. Because the first bit of the pixel drive data GD is logic level 1, an erasure discharge (indicated by overlapping circles) is induced in the discharge cells in the address steps W1 to W8 of the subfield SF1. Because discharge cells are initialized in the lit mode in the reset step R of the leading subfield SF0, sustained discharge light emission is implemented continuously in the sustain steps I that exist in the interval up until the erasure discharge is induced. For example, in the light emission drive sequence shown in FIG. 6A, the address steps are executed as follows:

Address step W6, which performs erasure discharge on the (8N-7)th display line group, is executed in the subfield $SF1_1$;

Address step W3, which performs erasure discharge on the (8N-6)th display line group, is executed in the subfield $SF1_2$;

Address step W8, which performs erasure discharge on the (8N-5)th display line group, is executed in the subfield $SF1_3$;

Address step W5, which performs erasure discharge on the (8N-4)th display line group, is executed in the subfield $SF1_4$;

Address step W2, which performs erasure discharge on the (8N-3)th display line group, is executed in the subfield $SF1_5$;

Address step W7, which performs erasure discharge on the (8N-2)th display line group, is executed in the subfield $SF1_6$;

Address step W4, which performs erasure discharge on the (8N-1)th display line group, is executed in the subfield $SF1_7$; and Address step W1, which performs erasure discharge on the (8N)th display line group, is executed in the subfield $SF1_8$.

Accordingly, as indicated by the white and overlapping circles in FIG. 7, the discharge cells perform a sustained discharge continuously in the sustain steps I of the following subfields:

Subfields $SF1_1$ to $SF1_8$ for the (8N-7)th display line;
Subfields $SF1_1$ to $SF1_5$ for the (8N-6)th display line;
Subfields $SF1_1$ to $SF1_2$ for the (8N-5)th display line;
Subfields $SF1_1$ to $SF1_7$ for the (8N-4)th display line;
Subfields $SF1_1$ to $SF1_4$ for the (8N-3)th display line;
Subfield $SF1_1$ for the (8N-2)th display line;
Subfields $SF1_1$ to $SF1_6$ for the (8N-1)th display line; and
Subfields $SF1_1$ to $SF1_3$ for the (8N)th display line.

That is, in the second grayscale driving in accordance with the '0100' pixel drive data GD, the discharge cells arranged on each display line are each driven at a luminance level corresponding with the period of the light emission produced by the sustained discharge induced in the course of a single field display period, as shown in FIG. 15. Specifically, the discharge cells arranged on the (8N-7)th display line are at the luminance level '8';

the discharge cells arranged on the (8N-6)th display lines are at the luminance level '5';

the discharge cells arranged on the (8N-5)th display lines are at the luminance level '2';

the discharge cells arranged on the (8N-4)th display lines are at the luminance level '7';

the discharge cells arranged on the (8N-3)th display lines are at the luminance level '4';

the discharge cells arranged on the (8N-2)th display lines are at the luminance level '1';

the discharge cells arranged on the (8N-1)th display lines are at the luminance level '6'; and the discharge cells arranged on the (8N)th display lines are at the luminance level '3'.

When '0010' pixel drive data GD representing a luminance one level higher than that of the '0100' pixel drive data is supplied, a light emission display based on third grayscale driving is performed. Because the second bit of the pixel drive data GD is logic level 1, an erasure discharge (indicated by overlapping circles) is induced in each discharge cell in the address steps W1 to W8 of the subfield SF2. The discharge cells are initialized in the lit mode in the reset step R of the leading subfield SF0, so that sustained discharge light emission is executed continuously in the sustain steps I that exist during the interval up until the erasure discharge is induced. For example, in the light emission drive sequence shown in FIG. 6A, the address steps are executed as follows:

address step W6, which performs erasure discharge on the (8N-7)th display line group, is executed in the subfield SF$2_1$;

address step W3, which performs erasure discharge on the (8N-6)th display line group, is executed in the subfield SF$2_2$;

address step W8, which performs erasure discharge on the (8N-5)th display line group, is executed in the subfield SF$2_3$;

address step W5, which performs erasure discharge on the (8N-4)th display line group, is executed in the subfield SF$2_4$;

address step W2, which performs erasure discharge on the (8N-3)th display line group, is executed in the subfield SF$2_5$;

address step W7, which performs erasure discharge on the (8N-2)th display line group, is executed in the subfield SF$2_6$;

address step W4, which performs erasure discharge on the (8N-1)th display line group, is executed in the subfield SF$2_7$; and address step W1, which performs erasure discharge on the (8N)th display line group, is executed in the subfield SF$2_8$.

Accordingly, as indicated by the white and overlapping circles in FIG. 7, the discharge cells perform a sustained discharge continuously in the sustain steps I of the following subfields:

Subfields SF$1_1$ to SF$1_8$ and the subfields SF$2_1$ to SF$2_8$ for the (8N-7)th display line;

Subfields SF$1_1$ to SF$1_8$ and the subfields SF$2_1$ to SF$2_5$ for the (8N-6)th display line;

Subfields SF$1_1$ to SF$1_8$ and the subfields SF$2_1$ to SF$2_2$ for the (8N-5)th display line;

Subfields SF$1_1$ to SF$1_8$ and the subfields SF$2_1$ to SF$2_7$ for the (8N-4)th display line;

Subfields SF$1_1$ to SF$1_8$ and the subfields SF$2_1$ to SF$2_4$ for the (8N-3)th display line;

Subfields SF$1_1$ to SF$1_8$ and the subfield SF$2_1$ for the (8N-2)th display line;

Subfields SF$1_1$ to SF$1_8$ and the subfields SF$2_1$ to SF$2_6$ for the (8N-1)th display line; and Subfields SF$1_1$ to SF$1_8$ and the subfields SF$2_1$ to SF$2_3$ for the (8N)th display line.

That is, in the third grayscale driving in accordance with the '0010' pixel drive data GD, the discharge cells arranged on each display line are each driven at a luminance level corresponding with the period of the light emission produced by the sustained discharge induced in the course of a single field display period, as shown in FIG. 15. Specifically, the discharge cells arranged on the (8N-7)th display lines are at the luminance level '16';

the discharge cells arranged on the (8N-6)th display lines are at the luminance level '13';

the discharge cells arranged on the (8N-5)th display lines are at the luminance level '10';

the discharge cells arranged on the (8N-4)th display lines are at the luminance level '15';

the discharge cells arranged on the (8N-3)th display lines are at the luminance level '12';

the discharge cells arranged on the (8N-2)th display lines are at the luminance level '9';

the discharge cells arranged on the (8N-1)th display lines are at the luminance level '14'; and the discharge cells arranged on the (8N)th display lines are at the luminance level '11'.

When '0001' pixel drive data GD representing a luminance one level higher than that of the '0010' pixel drive data is supplied, a light emission display based on fourth grayscale driving is performed as detailed below. Because the third bit of the pixel drive data GD is logic level 1, an erasure discharge (indicated by overlapping circles) is induced in each discharge cell in the address steps W1 to W8 of the subfield SF3. The discharge cells are initialized in the lit mode in the reset step R of the leading subfield SF0, so that sustained discharge light emission is executed continuously in the sustain steps I that exist during the interval up until the erasure discharge is induced. For example, in the light emission drive sequence shown in FIG. 6A, the address steps are executed as follows:

Address step W6, which performs erasure discharge on the (8N-7)th display line group, is executed in the subfield SF$3_1$;

Address step W3, which performs erasure discharge on the (8N-6)th display line group, is executed in the subfield SF$3_2$;

Address step W8, which performs erasure discharge on the (8N-5)th display line group, is executed in the subfield SF$3_3$;

Address step W5, which performs erasure discharge on the (8N-4)th display line group, is executed in the subfield SF$3_4$;

Address step W2, which performs erasure discharge on the (8N-3)th display line group, is executed in the subfield SF$3_5$;

Address step W7, which performs erasure discharge on the (8N-2)th display line group, is executed in the subfield SF$3_6$;

Address step W4, which performs erasure discharge on the (8N-1)th display line group, is executed in the subfield SF$3_7$; and Address step W1, which performs erasure discharge on the (8N)th display line group, is executed in the subfield SF$3_8$.

Accordingly, as indicated by the white and overlapping circles in FIG. 7, the discharge cells perform a sustained discharge continuously in the sustain steps I of the following subfields. Specifically, Subfields SF$1_1$ to SF$2_8$ and the subfields SF$3_1$ to SF$3_8$ for the (8N-7)th display line;

Subfields SF$1_1$ to SF$2_8$ and the subfields SF$3_1$ to SF$3_5$ for the (8N-6)th display line;

Subfields SF$1_1$ to SF$2_8$ and the subfields SF$3_1$ to SF$3_2$ for the (8N-5)th display line;

Subfields SF$1_1$ to SF$2_8$ and the subfields SF$3_1$ to SF$3_7$ for the (8N-4)th display line;

Subfields SF$1_1$ to SF$2_8$ and the subfields SF$3_1$ to SF$3_4$ for the (8N-3)th display line;

Subfields SF$1_1$ to SF$2_8$ and the subfield SF$3_1$ for the (8N-2)th display line;

Subfields SF$1_1$ to SF$2_8$ and the subfields SF$3_1$ to SF$3_6$ for the (8N-1)th display line;

Subfields SF$1_1$ to SF$2_8$ and the subfields SF$3_1$ to SF$3_3$ for the (8N)th display line.

That is, in the fourth grayscale driving in accordance with the '0001' pixel drive data GD, the discharge cells each emit light at a luminance level corresponding with the period of the light emission produced by the sustained discharge induced in the course of a single field display period, as shown in FIG. 15. Specifically, the discharge cells arranged on the (8N-7)th display lines are at the luminance level '24';

the discharge cells arranged on the (8N-6)th display lines are at the luminance level '21';

the discharge cells arranged on the (8N-5)th display lines are at the luminance level '18';

the discharge cells arranged on the (8N-4)th display lines are at the luminance level '23';

the discharge cells arranged on the (8N-3)th display lines are at the luminance level '20';

the discharge cells arranged on the (8N-2)th display lines are at the luminance level '17';

the discharge cells arranged on the (8N-1)th display lines are at the luminance level '22'; and the discharge cells arranged on the (8N)th display lines are at the luminance level '19'.

When '0000' pixel drive data GD representing the highest luminance is supplied, a light emission display based on the fifth grayscale driving is implemented. Because all the bits of the pixel drive data GD are logic level 0, erasure discharge is not induced at all during the single field display period. Accordingly, the discharge cells discharge light continuously in the sustain steps I of the subfields $SF1_1$ to $SF1_8$, $SF2_1$ to $SF2_8$, $SF3_1$ to $SF3_8$, and SF4.

That is, in the fifth grayscale driving in accordance with the '0000' pixel drive data GD, the discharge cells each emit light at a luminance level corresponding with the period of the light emission produced by the sustained discharge induced in the course of a single field display period as shown in FIG. 15. Specifically, the discharge cells arranged on the (8N-7)th display lines are at the luminance level '25';

the discharge cells arranged on the (8N-6)th display lines are at the luminance level '25';

the discharge cells arranged on the (8N-5)th display lines are at the luminance level '25';

the discharge cells arranged on the (8N-4)th display lines are at the luminance level '25';

the discharge cells arranged on the (8N-3)th display lines are at the luminance level '25';

the discharge cells arranged on the (8N-2)th display lines are at the luminance level '25';

the discharge cells arranged on the (8N-1)th display lines are at the luminance level '25'; and the discharge cells arranged on the (8N)th display lines are at the luminance level '25'.

Therefore, in the above described driving, the first to fifth grayscale driving that is capable of representing luminance corresponding to five levels is executed in accordance with five different pixel drive data GD, namely, '1000', '0100', '0010', '0001', and '0000'. Here, different luminance weightings are applied to eight adjacent display lines, and the eight adjacent display lines are driven at different luminance levels determined by the respective luminance weightings, in each of the first to fifth grayscale driving.

For example, the following luminance weightings ('1' to '8') are allocated to the eight adjacent display lines in the driving according to the light emission drive sequence for the first field shown in FIG. 6A:

(8N-7)th display line: '8';
(8N-6)th display line: '5';
(8N-5)th display line: '2';
(8N-4)th display line: '7';
(8N-3)th display line: '4';
(8N-2)th display line: '1';
(8N-1)th display line: '6'; and
(8N)th display line: '3'.

The following luminance weightings are allocated to the eight adjacent display lines in the driving according to the light emission drive sequence for the second field shown in FIG. 6B:

(8N-7)th display line: '4';
(8N-6)th display line: '1';
(8N-5)th display line: '6';
(8N-4)th display line: '3';
(8N-3)th display line: '8';
(8N-2)th display line: '5';
(8N-1)th display line: '2'; and
(8N)th display line: '7'.

The following luminance weightings are allocated to the eight adjacent display lines in the driving according to the light emission drive sequence for the third field shown in FIG. 6C:

(8N-7)th display line: '6';
(8N-6)th display line: '3';
(8N-5)th display line: '8';
(8N-4)th display line: '5';
(8N-3)th display line: '2';
(8N-2)th display line: '7';
(8N-1)th display line: '4'; and
(8N)th display line: '1'.

The following luminance weightings are allocated to the eight adjacent display lines in the driving according to the light emission drive sequence for the fourth field shown in FIG. 6D:

(8N-7)th display line: '2';
(8N-6)th display line: '7';
(8N-5)th display line: '4';
(8N-4)th display line: '1';
(8N-3)th display line: '6';
(8N-2)th display line: '3';
(8N-1)th display line: '8'; and
(8N)th display line: '5'.

The following luminance weightings are allocated to the eight adjacent display lines in the driving according to the light emission drive sequence for the fifth field shown in FIG. 6E:

(8N-7)th display line: '7';
(8N-6)th display line: '4';
(8N-5)th display line: '1';
(8N-4)th display line: '6';
(8N-3)th display line: '3';
(8N-2)th display line: '8';
(8N-1)th display line: '5'; and
(8N)th display line: '2'.

The following luminance weightings are allocated to the eight adjacent display lines in the driving according to the light emission drive sequence for the sixth field shown in FIG. 6F:

(8N-7)th display line: '3';
(8N-6)th display line: '8';
(8N-5)th display line: '5';
(8N-4)th display line: '2';
(8N-3)th display line: '7';
(8N-2)th display line: '4';
(8N-1)th display line: '1'; and
(8N)th display line: '6'.

The following luminance weightings are allocated to the eight adjacent display lines in the driving according to the light emission drive sequence for the seventh field shown in FIG. 6G:

(8N-7)th display line: '5';
(8N-6)th display line: '2';
(8N-5)th display line: '7';
(8N-4)th display line: '4';
(8N-3)th display line: '1';
(8N-2)th display line: '6';
(8N-1)th display line: '3'; and
(8N)th display line: '8'.

The following luminance weightings are allocated to the eight adjacent display lines in the driving according to the light emission drive sequence for the eighth field shown in FIG. 6H:

(8N-7)th display line: '1';
(8N-6)th display line: '6';
(8N-5)th display line: '3';
(8N-4)th display line: '8';
(8N-3)th display line: '5';
(8N-2)th display line: '2';
(8N-1)th display line: '7'; and
(8N)th display line: '4'.

As indicated by the light emission drive patterns shown in:

FIG. 7 for driving that corresponds with the light emission drive sequence of FIG. 6A;

FIG. 8 for driving that corresponds with the light emission drive sequence of FIG. 6B;

FIG. 9 for driving that corresponds with the light emission drive sequence of FIG. 6C;

FIG. 10 for driving that corresponds with the light emission drive sequence of FIG. 6D;

FIG. 11 for driving that corresponds with the light emission drive sequence of FIG. 6E;

FIG. 12 for driving that corresponds with the light emission drive sequence of FIG. 6F;

FIG. 13 for driving that corresponds with the light emission drive sequence of FIG. 6G; and FIG. 14 for driving that corresponds with the light emission drive sequence of FIG. 6H, the discharge cells belonging to the eight adjacent display lines are made to emit light at respective different luminance levels based on the above weighting.

The actual drive operation executed in accordance with the video input signal will be described by taking the driving in the first field shown in FIG. 6A as an example.

Figure 16:
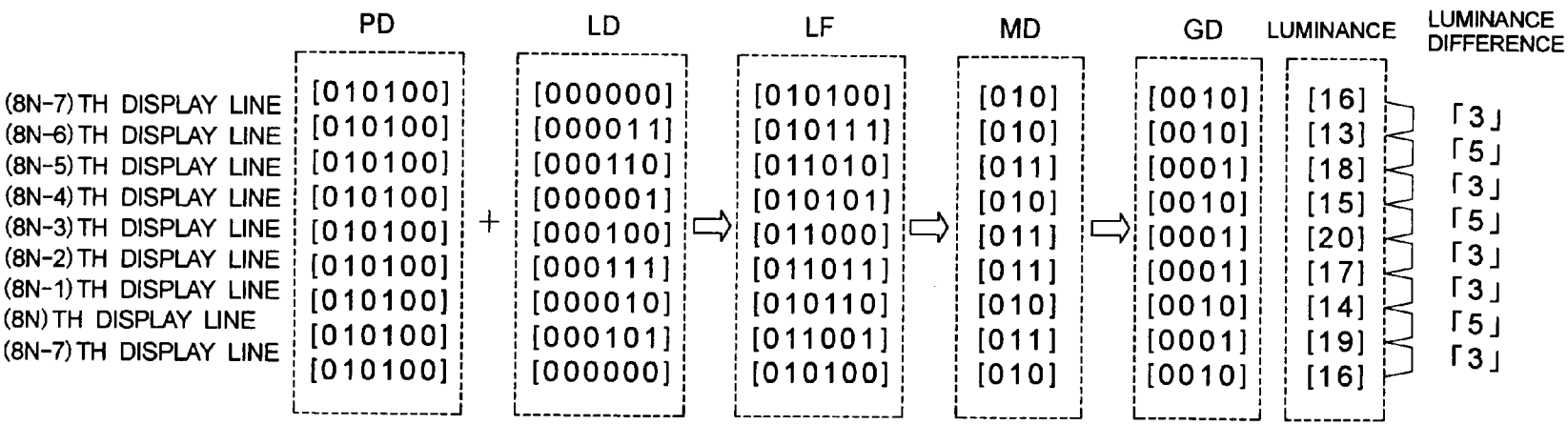
FIG. 16 illustrates line dither processing when '0101001' pixel data is supplied.

When the 6-bit pixel data PD corresponding with each column of discharge cells belonging to the eight adjacent display lines are all '010100', the line dither offset value generation circuit 21 adds the line dither offset values LD shown in FIG. 4A to the pixel data PD of the display lines, respectively, as shown in FIG. 16. As a result of this addition of the line dither offset values LD, the following line-offset-added pixel data LF are obtained for each of the display lines, as shown in FIG. 16. Specifically, (8N-7)th display line: the value LF is '010100';
(8N-6)th display line: the value LF is '010111';
(8N-5)th display line: the value LF is '011010';
(8N-4)th display line: the value LF is '010101';
(8N-3)th display line: the value LF is '011000';
(8N-2)th display line: the value LF is '011011';
(8N-1)th display line: the value LF is '010110'; and
(8N)th display line: the value LF is '011001'.

The lower bit discard circuit 23 discards the lower 3 bits of each of these line-offset-added pixel data LF, thereby obtaining the remaining upper 3 bits of data as the multiple grayscale pixel data MD. That is, as shown in FIG. 16, the following multiple grayscale pixel data MD are obtained for the eight adjacent display lines:

(8N-7)th display line: the data MD is '010';
(8N-6)th display line: the data MD is '010';
(8N-5)th display line: the data MD is '011';
(8N-4)th display line: the data MD is '010';
(8N-3)th display line: the data MD is '011';
(8N-2)th display line: the data MD is '011';
(8N-1)th display line: the data MD is '010'; and
(8N)th display line: the data MD is '011'.

These multiple grayscale pixel data MD are converted into 4-bit pixel drive data GD by the drive data conversion circuit 3. Specifically, (8N-.7)th display line: the data GD is '0010';
(8N-6)th display line: the data GD is '0010';
(8N-5)th display line: the data GD is '0001';
(8N-4)th display line: the data GD is '0010';
(8N-3)th display line: the data GD is '0001';
(8N-2)th display line: the data GD is '0001';,
(8N-1)th display line: the data GD is '0010'; and
(8N)th display line: the data GD is '0001'.

Therefore, as a result of the light emission drive patterns shown in FIG. 7, the discharge cells belonging to these eight adjacent display lines are driven to emit light at the following luminance levels:

discharge cells arranged on the (8N-7)th display line: the luminance level '16';

discharge cells arranged on the (8N-6)th display line: the luminance level '13';

discharge cells arranged on the (8N-5)th display line: the luminance level '18';

discharge cells arranged on the (8N-4)th display line: the luminance level '15';

discharge cells arranged on the (8N-3)th display line: the luminance level '20';

discharge cells arranged on the (8N-2)th display line: the luminance level '17';

discharge cells arranged on the (8N-1)th display line: the luminance level '14'; and discharge cells arranged on the (8N)th display line: the luminance level '19'.

Consequently, the luminance level produced by averaging the luminance levels of the eight display lines is observed.

As described above, the plasma display device shown in FIG. 3 drives each of the eight adjacent display lines to emit light such that the different line dither offset values LD are Added to pixel data PD of the display lines and the different luminance weightings are applied to the display lines. As a result of this driving, so-called line dither processing, which allows the luminance difference between adjacent display lines to be generated, is implemented.

In the line dither processing, the bias of the luminance difference between adjacent display lines of the PDP 100 should be substantially uniform. To this end, the bias is limited to lie within a predetermined value in this embodiment. For example, when '010100' pixel data PD is supplied, the bias of the luminance difference is '2', as shown in FIG. 16. Specifically, the luminance difference between the (8N-7)th and (8N-6)th display lines is '3';

the luminance difference between the (8N-6)th and (8N-5)th display lines is '5';

the luminance difference between the (8N-5)th and (8N-4)th display lines is '3';

the luminance difference between the (8N-4)th and (8N-3)th display lines is '5';

the luminance difference between the (8N-3)th and (8N-2)th display lines is '3';

the luminance difference between the (8N-2)th and (8N-1)th display lines is '3'; and the luminance difference between the (8N-1)th and (8N)th display lines is '5'.

It should be noted that when other pixel data PD ate supplied, the bias of the luminance difference between the adjacent display lines is equal to or less than '2' in this embodiment.

For example, according to the light emission drive patterns shown in FIG. 7, discharge cells belonging to the eight adjacent display lines emit light at luminance levels corresponding to the five grayscales as shown in FIG. 15. In the line dither processing used in this embodiment, the line dither offset values LD are added to the pixel data PD so that when a certain display line is driven with kth grayscale driving (k=1, 2, 3, 4, 5), the adjacent display lines are driven at kth grayscale driving or (k+1)th grayscale driving. Accordingly, for example, when the discharge cells arranged on the (8N-7)th display line are driven to emit light at the luminance level '16' by means of the third grayscale driving, the discharge cells arranged on the (8N-6)th display line are driven to emit light at the luminance level '13' by means of the third grayscale driving, or are driven to emit light at the luminance level '21' by means of the fourth grayscale driving. Thus, when the discharge cells arranged on the (8N-6)th display line are driven with the third grayscale driving, the difference in luminance between the (8N-6)th display line and (8N-7) display line is '3', whereas when the discharge cells on the (8N-6)th display line are driven with the fourth grayscale driving, the luminance difference between the (8N-6)th display line and (8N-7) display line is '5'. The bias of these two luminance differences is therefore '2'.

In this manner, when the line dither processing is executed, the bias of the luminance differences between adjacent display lines is restricted in a predetermined range, so that a high quality dither-processed image with a smaller luminance bias is expressed.

Figure 17:
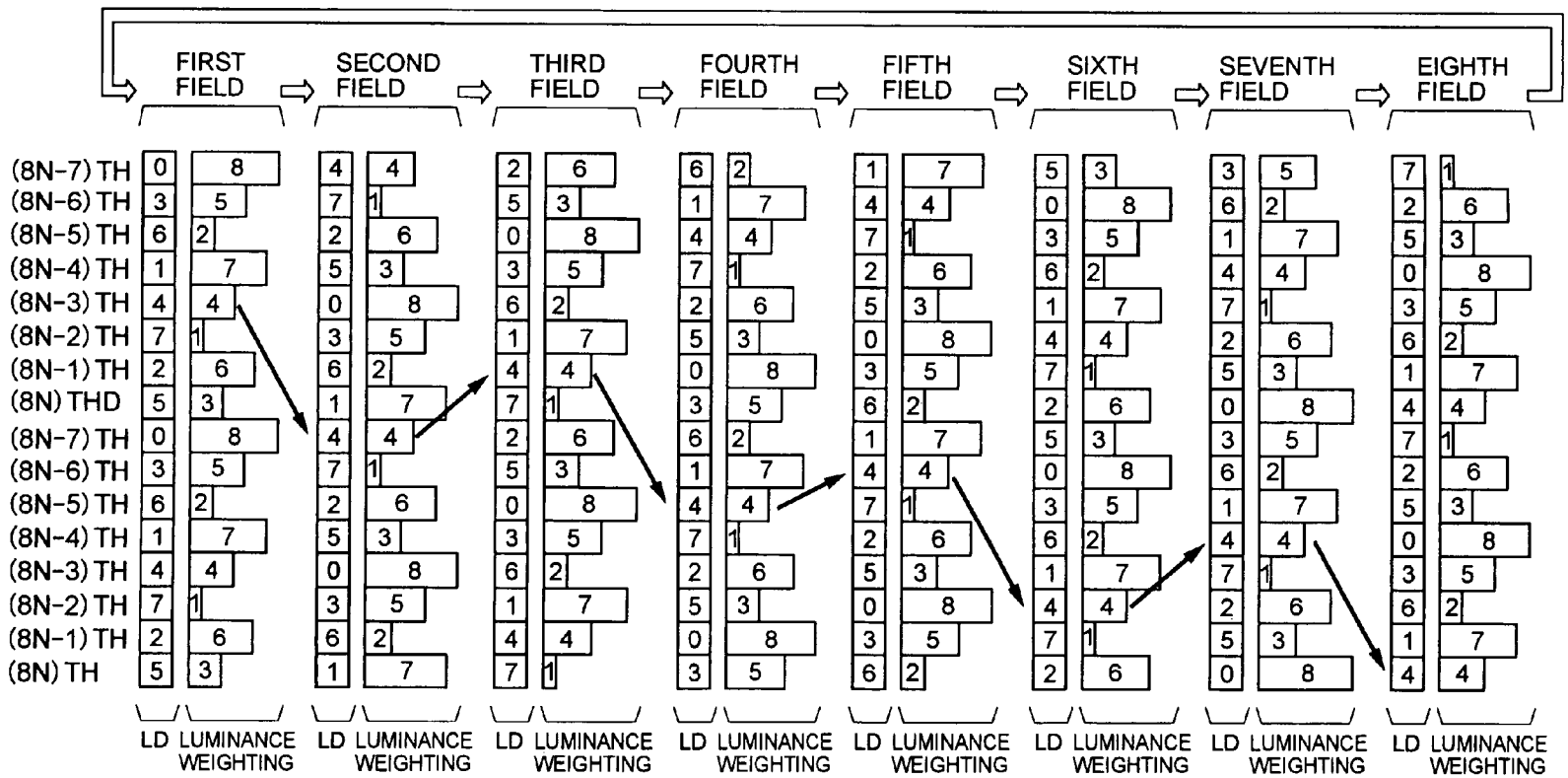
FIG. 17 shows a circulating transition of line dither weightings for the respective display lines and respective fields.

Further, in the line dither processing according to this embodiment, the first to eighth fields of the video input signal constitute one cycle, and the weighting of the line dither processing for each of the eight adjacent display lines is changed for each field as shown in FIG. 17.

That is, the allocation of the following line dither processes to the respective display lines is changed for each field:

First line dither processing, which adds a '0' line dither offset value LD to the pixel data PD and performs light emission driving corresponding with an '8' luminance weighting;

Second line dither processing, which adds a '1' line dither offset value LD to the pixel data PD and performs light emission driving corresponding with a '7' luminance weighting;

Third line dither processing, which adds a '2' line dither offset value LD to the pixel data PD and performs light emission driving corresponding with a '6' luminance weighting;

Fourth line dither processing, which adds a '3' line dither offset value LD to the pixel data PD and performs light emission driving corresponding with a '5' luminance weighting;

Fifth line dither processing, which adds a '4' line dither offset value LD to the pixel data PD and performs light emission driving corresponding with a '4' luminance weighting;

Sixth line dither processing, which adds a '5' line dither offset value LD to the pixel data PD and performs light emission driving corresponding with a '3' luminance weighting;

Seventh line dither processing, which adds a '6' line dither offset value LD to the pixel data PD and performs light emission driving corresponding with a '2' luminance weighting; and Eighth line dither processing, which adds a '7' line dither offset value LD to the pixel data PD and performs light emission driving corresponding with a '1' luminance weighting.

As shown in FIG. 17, in the first field, the first to eighth line dither processes are allocated to the display lines as follows:

(8N-7)th display line: first line dither processing;
(8N-6)th display line: fourth line dither processing;
(8N-5)th display line: seventh line dither processing;
(8N-4)th display line: second line dither processing;
(8N-3)th display line: fifth line dither processing;
(8N-2)th display line: eighth line dither processing;
(8N-1)th display line: third line dither processing; and
(8N)th display line: sixth line dither processing.

In the second field, the first to eighth line dither processes are allocated to the display lines as follows:

(8N-7)th display line: fifth line dither processing;
(8N-6)th display line: eighth line dither processing;
(8N-5)th display line: third line dither processing;
(8N-4)th display line: sixth line dither processing;
(8N-3)th display line: first line dither processing;
(8N-2)th display line: fourth line dither processing;
(8N-2)th display line: seventh line dither processing; and
(8N)th display line: second line dither processing.

In the third field, the first to eighth line dither processes are allocated to the display lines as follows:

(8N-7)th display line: third line dither processing;
(8N-6)th display line: sixth line dither processing;
(8N-5)th display line: first line dither processing;
(8N-4)th display line: fourth line dither processing;
(8N-3)th display line: seventh line dither processing;
(8N-2)th display line: second line dither processing;
(8N-1)th display line: fifth line dither processing; and
(8N)th display line: eighth line dither processing.

In the fourth field, the first to eighth line dither processes are allocated to the display lines as follows:

(8N-7)th display line: seventh line dither processing;
(8N-6)th display line: second line dither processing;
(8N-5)th display line: fifth line dither processing;
(8N-4)th display line: eighth line dither processing;
(8N-3)th display line: third line dither processing;
(8N-2)th display line: sixth line dither processing;
(8N-1)th display line: first line dither processing; and
(8N)th display line: fourth line dither processing.

In the fifth field, the first to eighth line dither processes are allocated to the display lines as follows:

(8N-7)th display line: second line dither processing;
(8N-6)th display line: fifth line dither processing;
(8N-5)th display line: eighth line dither processing;
(8N-4)th display line: third line dither processing;
(8N-3)th display line: sixth line dither processing;
(8N-2)th display line: first line dither processing;
(8N-1)th display line: fourth line dither processing; and
(8N)th display line: seventh line dither processing.

In the sixth field, the first to eighth line dither processes are allocated to the display lines as follows:

(8N-7)th display line: sixth line dither processing;
(8N-6)th display line: first line dither processing;
(8N-5)th display line: fourth line dither processing;
(8N-4)th display line: seventh line dither processing;
(8N-3)th display line: second line dither processing;
(8N-2)th display line: fifth line dither processing;
(8N-1)th display line: eighth line dither processing; and
(8N)th display line: third line dither processing.

In the seventh field, the first to eighth line dither processes are allocated to the display lines as follows:

(8N-7)th display line: fourth line dither processing;
(8N-6)th display line: seventh line dither processing;
(8N-5)th display line: second line dither processing;
(8N-4)th display line: fifth line dither processing;
(8N-3)th display line: eighth line dither processing;
(8N-2)th display line: third line dither processing;
(8N-1)th display line: sixth line dither processing; and
(8N)th display line: first line dither processing.

In the eighth field, the first to eighth line dither processes are allocated to the display lines as follows:

(8N-7)th display line: eighth line dither processing;
(8N-6)th display line: third line dither processing;
(8N-5)th display line: sixth line dither processing;
(8N-4)th display line: first line dither processing;
(8N-3)th display line: fourth line dither processing;
(8N-2)th display line: seventh line dither processing;
(8N-1)th display line: second line dither processing; and
(8N)th display line: fifth line dither processing.

In this embodiment, the respective line dither processing is applied alternately to upper and lower display in the screen for each field.

For example, in FIG. 17, the fifth line dither processing, which adds a '4' line dither offset value LD to the pixel data PD and performs light emission driving corresponding with a '4' luminance weighting, is allocated to the (8N-3)th display line in the first field. However, in the second field, the fifth line dither processing is performed on the (8N-7)th display line located below the (8N-3)th display line in the screen as indicated by the arrow. In the third field, the fifth line dither processing is performed on the (8N-1)th display line located above the (8N-7)th display line as shown by the arrow. In the fourth field, the fifth line dither processing is performed on the (8N-5)th display line located below the (8N-1)th display line as indicated by the arrow. In the fifth field, the fifth line dither processing is performed on the (8N-6)th display line located above the (8N-5)th display line as indicated by the arrow. In the sixth field, the fifth line dither processing is performed on the (8N-2)th display line located below the (8N-6)th display line as indicated by the arrow. In the seventh field, the fifth line dither processing is performed on the (8N-4)th display line located above the (8N-2)th display line as indicated by the arrow. In the eighth field, the fifth line dither processing is performed on the (8N)th display line located below the (8N-4)th display line as indicated by the arrow.

Accordingly, there is a low probability of the viewer of the picture displayed on the screen of the PDP 100 continuously gazing at the pixels emitting light with the same luminance while casting his or her eyes over the screen. Therefore, a favorable dither display in which pseudo contours are not readily observed is implemented.

In the driving as described above, the subfield SF1 bears a low-luminance grayscale, the subfield SF2 bears a medium-luminance grayscale, and the subfield SF3 bears a high-luminance grayscale. The subfields SF1, SF2 and SF3 are further divided into the eight subfields $SF1_1$ to $SF1_8$, $SF2_1$ to $SF2_8$, and $SF3_1$ to $SF3_8$ respectively, as shown in FIG. 6, for example.

When driving is performed by allocating a light emission period corresponding with the weighting of the subfield to each of the subfields SF1 to SF3, the light emission period to be allocated to the subfield SF1 bearing the low-luminance grayscale is short, and therefore cases where the subfield SF1 cannot be divided into eight sometimes arise.

FIGS. 18A to 18H show examples of the light emission drive sequence of the present invention, which is executed with this point in mind.

Figures 18E, 18F, 18G, 18H:
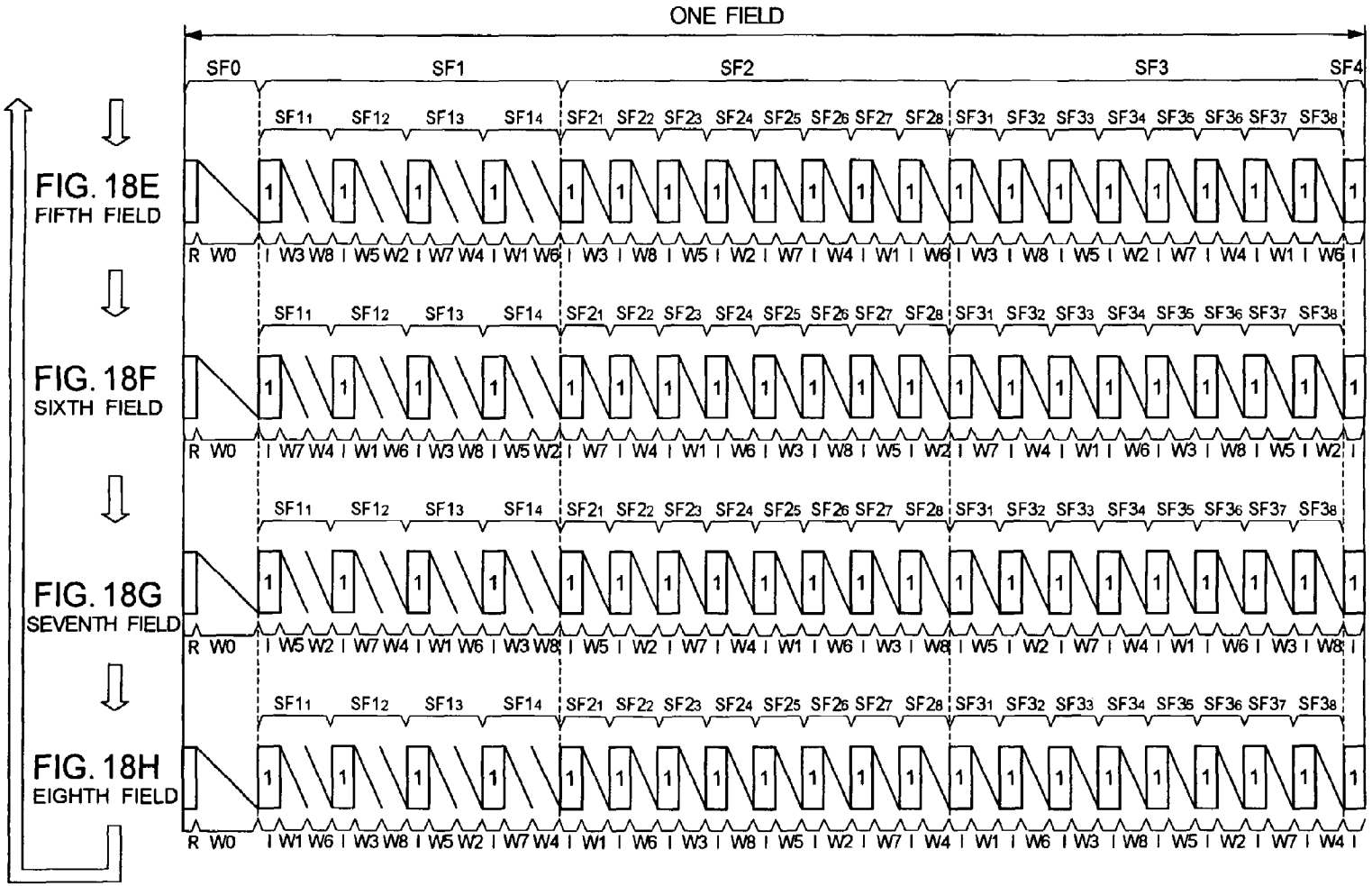

That is, the drive control circuit 6 supplies, to the column electrode driver circuit 5, the row electrode Y driver circuit 7 and the row electrode X driver circuit 8, various timing signals for grayscale-driving of the PDP 100 in accordance with the light emission drive sequences shown in the following figures in the following fields of the video input signal:

first field: drive sequence shown in FIG. 18A;
second field: drive sequence shown in FIG. 18B;
third field: drive sequence shown in FIG. 18C;
fourth field: drive sequence shown in FIG. 18D;
fifth field: drive sequence shown in FIG. 18E;
sixth field: drive sequence shown in FIG. 18F;
seventh field: drive sequence shown in FIG. 18G; and
eighth field: drive sequence shown in FIG. 18H.

Further, the drive control circuit 6 repeatedly executes a series of driving shown in FIGS. 18A to 18H. Each of the column electrode driver circuit 5, the row electrode Y driver circuit 7, and the row electrode X driver circuit 8 generates various drive pulses (not shown) that are utilized to drive the PDP 100 as described below in accordance with the timing signals supplied by the drive control circuit 6, and applies these drive pulses to the column electrodes $D_1$ to $D_m$, row electrodes $X_1$ to $X_n$, and row electrodes $Y_1$ to $Y_n$ of the PDP 100.

Further, in the light emission drive sequence shown in FIGS. 18A to 18H, each of the fields of the video input signal is divided into five subfields SF0 to SF4.

The leading subfield SF0 sequentially executes a reset step R and an address step W0. The reset step R causes all the discharge cells $G_{(1,1)}$ to $G_{(n,m)}$ of the PDP 100 to perform a reset discharge all together and initializes the discharge cells $G_{(1,1)}$ to $G_{(n,m)}$ in the lit mode (state in which a wall charge of a predetermined amount is formed). In the address step W0, the discharge cells G arranged on the first to nth display lines of the PDP 100 are selectively made to perform an erase discharge in accordance with the pixel drive data GD as shown in FIG. 5, in sequence one display line at a time, to make the transition to the unlit mode (state where the wall charge has been erased). The discharge cells in which an erasure discharge is not induced in this address step W0 retain their state up until immediately before this address step W0, that is, the lit mode.

As shown in FIGS. 18A to 18H, the subfield SF1 is further divided into four subfields $SF1_1$ to $SF1_4$ respectively. Likewise, the subfield SF2 is divided into eight subfields $SF2_1$ to $SF2_8$, and the subfield SF3 is divided into eight subfields $SF3_1$ to $SF3_8$. A sustain step I, in which only the discharge cells set to the lit mode are made to discharge light continuously over period '1', and address steps W1 to W8 as described below are executed in the subfields SF1 to SF3 respectively.

In the address step W1, only those discharge cells that are arranged on the (8N-7)th display lines, namely the 1st, 9th, 17th, . . . , and (n-7)th display lines, among all the discharge cells $G_{(1,1)}$ to $G_{(n,m)}$ formed in the PDP 100, are selectively caused to perform an erasure discharge in accordance with the pixel drive data. As a result, the discharge cells in which the erasure discharge is induced are set to the unlit mode, and the discharge cells in which the erasure discharge is not induced retain the state up until immediately before the address step W1. That is, the address step W1 sets the discharge cells arranged on the (8N-7)th display lines to either the unlit or lit mode in accordance with the pixel drive data.

In the address step W2, only those discharge cells arranged on the (8N-6)th display lines, namely the 2nd, 10th, 18th, . . . , and (n-6)th display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until immediately before the address step W2. That is, the address step W2 sets the discharge cells arranged on the (8N-6)th display lines to either the unlit or lit mode in accordance with the pixel drive data.

In address step W3, only discharge cells arranged on the (8N-5)th display lines, namely the 3rd, 11th, 19th, . . . , and (n-5)th display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until directly before the address step W3. Thus, the address step W3 sets the discharge cells arranged on the (8N-5)th display lines to either the unlit or the lit mode in accordance with the pixel drive data.

In address step W4, only discharge cells arranged on the (8N-4)th display lines, namely the 4th, 12th, 20th, . . . , and (n-4)th display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until directly before the address step W4. Thus, the address step W4 sets the discharge cells arranged on the (8N-4)th display lines to either the unlit or lit mode in accordance with the pixel drive data.

In the address step W5, only those discharge cells arranged on the (8N-3)th display lines, namely the 5th, 13th, 21st, . . . , and (n-3)th display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until directly before the address step W5. That is, the address step W5 sets the discharge cells arranged on the (8N-3)th display lines to either the unlit or lit mode in accordance with the pixel drive data.

In the address step W6, only those discharge cells arranged on the (8N-2)th display lines, namely the 6th, 14th, 22nd, . . . , and (n-2)th display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until directly before the address step W6. Thus, the address step W6 sets the discharge cells arranged on the (8N-2)th display lines to either the unlit or lit mode in accordance with the pixel drive data.

In the address step W7, only the discharge cells arranged on the (8N-1)th display lines, namely the 7th, 15th, 23rd, . . . , and (n-1)th display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until directly before the address step W7. That is, the address step W7 sets the discharge cells arranged on the (8N-1)th display lines to either the unlit or lit mode in accordance with the pixel drive data.

In the address step W8, only the discharge cells arranged on the (8N)th display lines, namely the 8th, 16th, 24th, . . . , and nth display lines, are selectively made to perform the erasure discharge in accordance with the pixel drive data. As a result, the discharge cells in which the erasure discharge is induced are set to the unlit mode, and the discharge cells in which the erasure discharge is not induced retain the state up until directly before the address step W8. Thus, the address step W8 sets the discharge cells arranged on the (8N)th display lines to either the unlit or lit mode in accordance with the pixel drive data.

Here, in the light emission drive sequence shown in FIG. 18A, the following steps are executed in sequence as below:

the sustain step I and the address steps W6 and W3 are executed in sequence in the subfield $SF1_1$;

the sustain step I and the address steps W8 and W5 are executed in sequence in the subfield $SF1_2$;

the sustain step I and the address steps W2 and W7 are executed in sequence in the subfield $SF1_3$;

the sustain step I and the address steps W4 and W1 are executed in sequence in the subfield $SF1_4$;

the sustain step I and the address step W6 are executed in sequence in the subfields $SF2_1$ and $SF3_1$;

the sustain step I and the address step W3 are executed in sequence in the subfields $SF2_2$ and $SF3_2$;

the sustain step I and the address step W8 are executed in sequence in the subfields $SF2_3$ and $SF3_3$;

the sustain step I and the address step W5 are executed in sequence in the subfields $SF2_4$ and $SF3_4$;

the sustain step I and the address step W2 are executed in sequence in the subfields $SF2_5$ and $SF3_5$;

the sustain step I and the address step W7 are executed in sequence in the subfields $SF2_6$ and $SF3_6$;

the sustain step I and the address step W4 are executed in sequence in the subfields $SF2_7$ and $SF3_7$; and the sustain step I and the address step W1 are executed in sequence in the subfields $SF2_8$ and $SF3_8$.

In the light emission drive sequence shown in FIG. 18B, the following steps are executed in sequence as below:

the sustain step I and the address steps W2 and W7 are executed in sequence in the subfield $SF1_1$;

the sustain step I and the address steps W4 and W1 are executed in sequence in the subfield $SF1_2$;

the sustain step I and the address steps W6 and W3 are executed in sequence in the subfield $SF1_3$;

the sustain step I and the address steps W8 and W5 are executed in sequence in the subfield $SF1_4$;

the sustain step I and the address step W2 are executed in sequence in the subfields SF2, and $SF3_1$;

the sustain step I and the address step W7 are executed in sequence in the subfields $SF2_2$ and $SF3_2$;

the sustain step I and the address step W4 are executed in sequence in the subfields $SF2_3$ and $SF3_3$;

the sustain step I and the address step W1 are executed in sequence in the subfields $SF2_4$ and $SF3_4$;

the sustain step I and the address step W6 are executed in sequence in the subfields $SF2_5$ and $SF3_5$;

the sustain step I and the address step W3 are executed in sequence in the subfields $SF2_6$ and $SF3_6$;

the sustain step I and the address step W8 are executed in sequence in the subfields $SF2_7$ and $SF3_7$; and the sustain step I and the address step W5 are executed in sequence in the subfields $SF2_8$ and $SF3_8$.

In the light emission drive sequence shown in FIG. 18C, the following steps are executed in sequence as below:

the sustain step I and the address steps W8 and W5 are executed in sequence in the subfield $SF1_1$;

the sustain step I and the address steps W2 and W7 are executed in sequence in the subfield $SF1_2$;

the sustain step I and the address steps W4 and W1 are executed in sequence in the subfield $SF1_3$;

the sustain step I and the address steps W6 and W3 are executed in sequence in the subfield $SF1_4$;

the sustain step I and the address step W8 are executed in sequence in the subfields $SF2_1$ and $SF3_1$;

the sustain step I and the address step W5 are executed in sequence in the subfields $SF2_2$ and $SF3_2$;

the sustain step I and the address step W2 are executed in sequence in the subfields $SF2_3$ and $SF3_3$;

the sustain step I and the address step W7 are executed in sequence in the subfields $SF2_4$ and $SF3_4$;

the sustain step I and the address step W4 are executed in sequence in the subfields $SF2_5$ and $SF3_5$;

the sustain step I and the address step W1 are executed in sequence in the subfields $SF2_6$ and $SF3_6$;

the sustain step I and the address step W6 are executed in sequence in the subfields $SF2_7$ and $SF3_7$; and the sustain step I and the address step W3 are executed in sequence in the subfields $SF2_8$ and $SF3_8$.

In the light emission drive sequence shown in FIG. 18D, the following steps are executed in sequence as below:

the sustain step I and the address steps W4 and W1 are executed in sequence in the subfield $SF1_1$;

the sustain step I and the address steps W6 and W3 are executed in sequence in the subfield $SF1_2$;

the sustain step I and the address steps W8 and W5 are executed in sequence in the subfield $SF1_3$;

the sustain step I and the address steps W2 and W7 are executed in sequence in the subfield $SF1_4$;

the sustain step I and the address step W4 are executed in sequence in the subfields $SF2_1$ and $SF3_1$;

the sustain step I and the address step W1 are executed in sequence in the subfields $SF2_2$ and $SF3_2$;

the sustain step I and the address step W6 are executed in sequence in the subfields $SF2_3$ and $SF3_3$;

the sustain step I and the address step W3 are executed in sequence in the subfields $SF2_4$ and $SF3_4$;

the sustain step I and the address step W8 are executed in sequence in the subfields $SF2_5$ and $SF3_5$;

the sustain step I and the address step W5 are executed in sequence in the subfields $SF2_6$ and $SF3_6$;

the sustain step I and the address step W2 are executed in sequence in the subfields $SF2_7$ and $SF3_7$; and the sustain step I and the address step W7 are executed in sequence in the subfields $SF2_8$ and $SF3_8$.

In the light emission drive sequence shown in FIG. 18E, the following steps are executed in sequence as below:

the sustain step I and the address steps W3 and W8 are executed in sequence in the subfield $SF1_1$;

the sustain step I and the address steps W5 and W2 are executed in sequence in the subfield $SF1_2$;

the sustain step I and the address steps W7 and W4 are executed in sequence in the subfield $SF1_3$;

the sustain step I and the address steps W1 and W6 are executed in sequence in the subfield $SF1_4$;

the sustain step I and the address step W3 are executed in sequence in the subfields $SF2_1$ and $SF3_1$;

the sustain step I and the address step W8 are executed in sequence in the subfields $SF2_2$ and $SF3_2$;

the sustain step I and the address step W5 are executed in sequence in the subfields $SF2_3$ and $SF3_3$;

the sustain step I and the address step W2 are executed in sequence in the subfields $SF2_4$ and $SF3_4$;

the sustain step I and the address step W7 are executed in sequence in the subfields $SF2_5$ and $SF3_5$;

the sustain step I and the address step W4 are executed in sequence in the subfields $SF2_6$ and $SF3_6$;

the sustain step I and the address step W1 are executed in sequence in the subfields $SF2_7$ and $SF3_7$; and the sustain step I and the address step W6 are executed in sequence in the subfields $SF2_8$ and $SF3_8$.

In the light emission drive sequence shown in FIG. 18F, the following steps are executed in sequence as below:

the sustain step I and the address steps W7 and W4 are executed in sequence in the subfield $SF1_1$;

the sustain step I and the address steps W1 and W6 are executed in sequence in the subfield $SF1_2$;

the sustain step I and the address steps W3 and W8 are executed in sequence in the subfield $SF1_3$;

the sustain step I and the address steps W5 and W2 are executed in sequence in the subfield $SF1_4$;

the sustain step I and the address step W7 are executed in sequence in the subfields $SF2_1$ and $SF3_1$;

the sustain step I and the address step W4 are executed in sequence in the subfields $SF2_2$ and $SF3_2$;

the sustain step I and the address step W1 are executed in sequence in the subfields $SF2_3$ and $SF3_3$;

the sustain step I and the address step W6 are executed in sequence in the subfields $SF2_4$ and $SF3_4$;

the sustain step I and the address step W3 are executed in sequence in the subfields $SF2_5$ and $SF3_5$;

the sustain step I and the address step W8 are executed in sequence in the subfields $SF2_6$ and $SF3_6$;

the sustain step I and the address step W5 are executed in sequence in the subfields $SF2_7$ and $SF3_7$; and the sustain step I and the address step W2 are executed in sequence in the subfields $SF2_8$ and $SF3_8$.

In the light emission drive sequence shown in FIG. 18G, the following steps are executed in sequence as below:

the sustain step I and the address steps W5 and W2 are executed in sequence in the subfield $SF1_1$;

the sustain step I and the address steps W7 and W4 are executed in sequence in the subfield $SF1_2$;

the sustain step I and the address steps W1 and W6 are executed in sequence in the subfield $SF1_3$;

the sustain step I and the address steps W3 and W8 are executed in sequence in the subfield $SF1_4$;

the sustain step I and the address step W5 are executed in sequence in the subfields $SF2_1$ and $SF3_1$;

the sustain step I and the address step W2 are executed in sequence in the subfields $SF2_2$ and $SF3_2$;

the sustain step I and the address step W7 are executed in sequence in the subfields $SF2_3$ and $SF3_3$;

the sustain step I and the address step W4 are executed in sequence in the subfields $SF2_4$ and $SF3_4$;

the sustain step I and the address step W1 are executed in sequence in the subfields $SF2_5$ and $SF3_5$;

the sustain step I and the address step W6 are executed in sequence in the subfields $SF2_6$ and $SF3_6$;

the sustain step I and the address step W3 are executed in sequence in the subfields $SF2_7$ and $SF3_7$; and the sustain step I and the address step W8 are executed in sequence in the subfields $SF2_8$ and $SF3_8$.

In the light emission drive sequence shown in FIG. 18H, the following steps are executed in sequence as below:

the sustain step I and the address steps W1 and W6 are executed in sequence in the subfield $SF1_1$;

the sustain step I and the address steps W3 and W8 are executed in sequence in the subfield $SF1_2$;

the sustain step I and the address steps W5 and W2 are executed in sequence in the subfield $SF1_3$;

the sustain step I and the address steps W7 and W4 are executed in sequence in the subfield $SF1_4$;

the sustain step I and the address step W1 are executed in sequence in the subfields $SF2_1$ and $SF3_1$;

the sustain step I and the address step W6 are executed in sequence in the subfields $SF2_2$ and $SF3_2$;

the sustain step I and the address step W3 are executed in sequence in the subfields $SF2_3$ and $SF3_3$;

the sustain step I and the address step W8 are executed in sequence in the subfields $SF2_4$ and $SF3_4$;

the sustain step I and the address step W5 are executed in sequence in the subfields $SF2_5$ and $SF3_5$;

the sustain step I and the address step W2 are executed in sequence in the subfields $SF2_6$ and $SF3_6$;

the sustain step I and the address step W7 are executed in sequence in the subfields $SF2_7$ and $SF3_7$; and the sustain step I and the address step W4 are executed in sequence in the subfields $SF2_8$ and $SF3_8$.

Further, only the sustain step I, in which only the discharge cells set to the lit mode are made to discharge light continuously over period '1', is executed in the final subfield SF4.

The drive control circuit 6 performs light emission driving as shown in FIGS. 19 to 26 in accordance with the light emission drive sequences shown in FIGS. 18A to. 18H.

FIG. 19 shows light emission drive pattern based on the light emission drive sequence in FIG. 18A;

FIG. 20 shows light emission drive pattern based on the light emission drive sequence in FIG. 18B;

FIG. 21 shows light emission drive pattern based on the light emission drive sequence in FIG. 18C;

FIG. 22 shows light emission drive pattern based on the light emission drive sequence in FIG. 18D;

FIG. 23 shows light emission drive pattern based on the light emission drive sequence in FIG. 18E;

FIG. 24 shows light emission drive pattern based on the light emission drive sequence in FIG. 18F;

FIG. 25 shows light emission drive pattern based on the light emission drive sequence in FIG. 18G; and FIG. 26 shows light emission drive pattern based on the light emission drive sequence in FIG. 18H;

When '1000' pixel drive data GD, which represents the lowest luminance, is supplied, a light emission display based on first grayscale driving as detailed below, is executed. Because the 0th bit of the pixel drive data GD is logic level 1, an erasure discharge (indicated by the black circles) is induced in the discharge cells in the address step W0 of the subfield SF0, and the discharge cells make the transition to the unlit mode. In the driving operations shown in FIGS. 18A to 18H, the opportunity, in a single field display period, for discharge cells to make the transition from the unlit mode to the lit mode state arises only in the reset step R of the leading subfield SF0. Accordingly, discharge cells that have made the transition to the unlit mode retain the unlit state throughout the single field display period.

Figure 27:
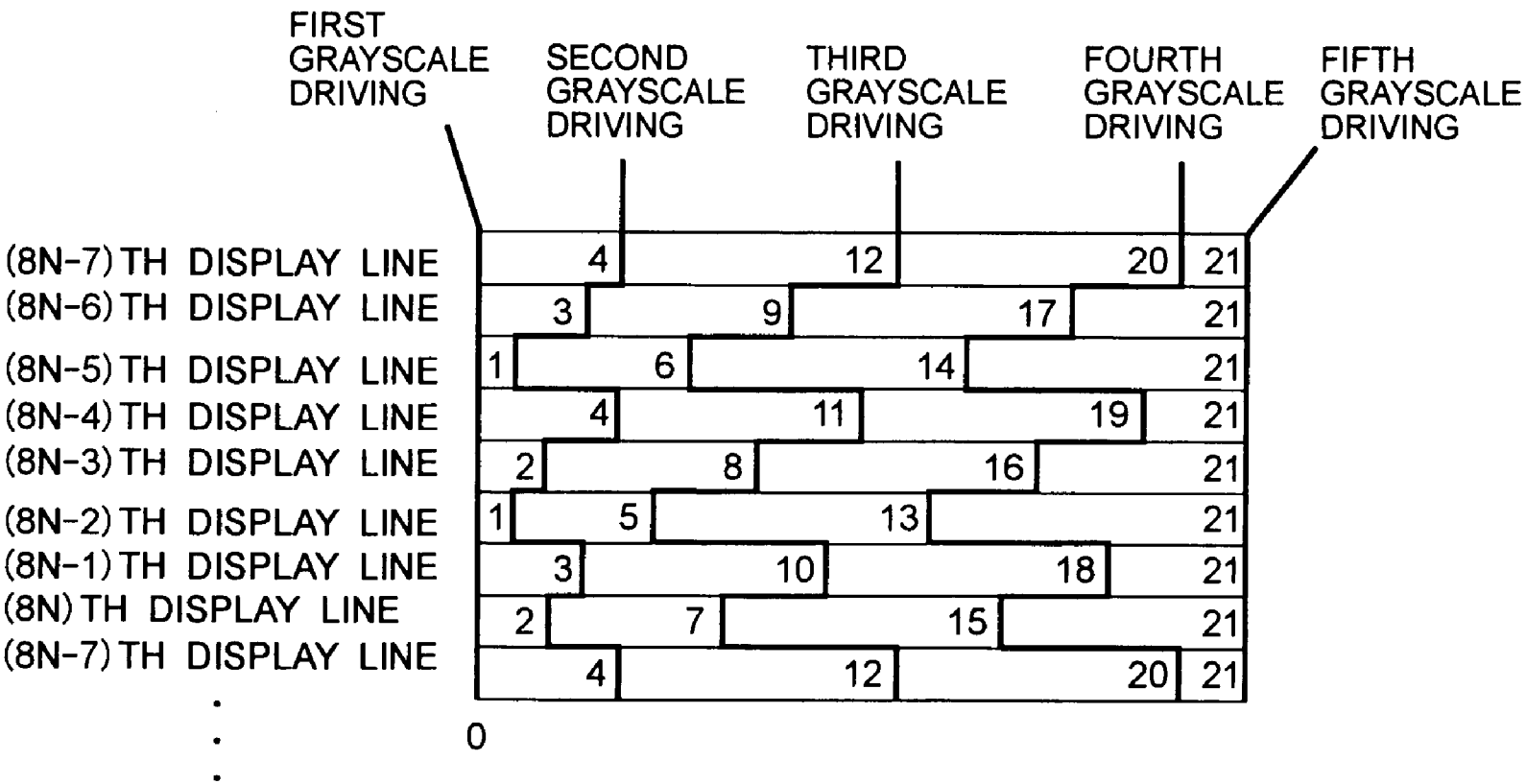
FIG. 27 shows a diagram, for each display line, the luminance levels in the first to fifth grayscale driving.

In other words, in the first grayscale driving in accordance with the '1000' pixel drive data GD, each discharge cell retains an unlit state throughout a single field display period, so that driving at the luminance level 0 is implemented as shown in FIG. 27.

Next, when the pixel drive data GD '0100' representing a luminance one level higher than that of the pixel drive data '1000' is supplied, a light emission display based on second grayscale driving is implemented as detailed below. Because the first bit of the pixel drive data GD is logic level 1, an erasure discharge (indicated by overlapping circles) is induced in the discharge cells in the address steps W1 to W8 of the subfield SF1. The discharge cells are initialized in the lit mode in the reset step R of the leading subfield SF0 so that sustained discharge light emission is implemented continuously in sustain steps I that exist in the interval up until the erasure discharge is induced. Therefore, for example, in the light emission drive sequence shown in FIG. 18A, the discharge cells on the display lines perform a sustained discharge continuously in the sustain step I of each of the following subfields:

(8N-7)th display line: subfields $SF1_1$ to $SF1_4$;

(8N-6)th display line: subfields $SF1_1$ to $SF1_3$;

(8N-5)th display line: subfield $SF1_1$;

(8N-4)th display line: subfields $SF1_1$ to $SF1_4$;

(8N-3)th display line: subfields $SF1_1$ to $SF1_2$;

(8N-2)th display line: subfield $SF1_1$;

(8N-1)th display line: subfields $SF1_1$ to $SF1_3$;

(8N)th display line: subfields $SF1_1$ to $SF1_2$, as indicated by the white circles and overlapping circles of the FIG. 19.

That is, in the second grayscale driving according to the '0100' pixel drive data GD, the discharge cells arranged on each display line are each driven to emit light at a luminance level that corresponds with the period of the light emission generated by the sustained discharge induced during the single field display period. Specifically, as shown in FIG. 27, the discharge cells arranged on the (8N-7)th display line are at luminance level '4';

the discharge cells arranged on the (8N-6)th display line are at luminance level '3';

the discharge cells arranged on the (8N-5)th display line are at luminance level '1';

the discharge cells arranged on the (8N-4)th display line are at luminance level '4';

the discharge cells arranged on the (8N-3)th display line are at luminance level '2';

the discharge cells arranged on the (8N-2)th display line are at luminance level '1';

the discharge cells arranged on the (8N-1)th display line are at luminance level '3'; and the discharge cells arranged on the (8N)th display line are at luminance level '2'.

When the pixel drive data GD '0010' representing a luminance one level higher than that of the pixel drive data '0100' is supplied, a light emission display based on third grayscale driving is implemented as detailed below. Because the second bit of the pixel drive data GD is logic level 1, the erasure discharge (indicated by overlapping circles) is induced in the discharge cells in address steps W1 to W8 of the subfield SF2. The discharge cells are initialized in the lit mode in the reset step R of the leading subfield SF0 so that sustained discharge light emission is implemented continuously in sustain steps I that exist in the interval up until the erasure discharge is induced. For example, in the light emission drive sequence shown in FIG. 18A, the discharge cells on the display lines perform a sustained discharge continuously in the sustain step I of each of the following subfields:

(8N-7)th display line: subfields $SF1_1$ to $SF1_4$, $SF2_1$, to $SF2_8$;

(8N-6)th display line: subfields $SF1_1$ to $SF1_4$, $SF2_1$ to $SF2_5$;

(8N-5)th display line: subfields $SF1_1$ to $SF1_4$, $SF2_1$ to $SF2_2$;

(8N-4)th display line: subfields $SF1_1$ to $SF1_4$, $SF2_1$ to $SF2_7$;

(8N-3)th display line: subfields $SF1_1$ to $SF1_4$, $SF2_1$ to $SF2_4$;

(8N-2)th display line: subfields $SF1_1$ to $SF1_4$, $SF2_1$;

(8N-1)th display line: subfields $SF1_1$ to $SF1_4$; $SF2_1$ to $SF2_6$;

(8N)th display line: subfields $SF1_1$ to $SF1_4$, $SF2_1$ to $SF2_3$, as indicated by the white circles and overlapping circles of the FIG. 19.

Thus, in the third grayscale driving according to the '0010' pixel driving data GD, the discharge cells arranged on the respective display lines are each driven at a luminance level that corresponds with the period of the light emission generated by the sustained discharge induced during the single field display period, that is, as shown in FIG. 27, the discharge cells arranged on the (8N-7)th display line are at luminance level '12';

the discharge cells arranged on the (8N-6)th display line are at luminance level '9';

the discharge cells arranged on the (8N-5)th display line are at luminance level '6';

the discharge cells arranged on the (8N-4)th display line are at luminance level '11';

the discharge cells arranged on the (8N-3)th display line are at luminance level '8';

the discharge cells arranged on the (8N-2)th display line are at luminance level '5';

the discharge cells arranged on the (8N-1)th display line are at luminance level '10'; and the discharge cells arranged on the (8N)th display line are at luminance level '7'.

When '0001' pixel drive data GD representing a luminance one level higher than that of the '0010' pixel drive data is supplied, a light emission display based on fourth grayscale driving is performed as detailed below. Because the third bit of the pixel drive data GD is logic level 1, the erasure discharge (indicated by overlapping circles) is induced in each discharge cell in the address steps W1 to W8 of the subfield SF3. The discharge cells are initialized in the lit mode in the reset step R of the leading subfield SF0, and then sustained discharge light emission is executed continuously in sustain steps I that exist during the interval up until the erasure discharge is induced. For example, in the light emission drive sequence shown in FIG. 18A, the discharge cells on the display lines perform a sustained discharge continuously in the sustain step I of each of the following subfields:

(8N-7)th display line: subfields $SF1_1$ to $SF2_8$, $SF3_1$ to $SF3_8$;

(8N-6)th display line: subfields $SF1_1$ to $SF2_8$, $SF3_1$ to $SF3_5$;

(8N-5)th display line: subfields $SF1_1$ to $SF2_8$, $SF3_1$ to $SF3_2$;

(8N-4)th display line: subfields $SF1_1$ to $SF2_8$, $SF3_1$ to $SF3_7$;

(8N-3)th display line: subfields $SF1_1$ to $SF2_8$, $SF3_1$ to $SF3_4$;

(8N-2)th display line: subfields $SF1_1$ to $SF2_8$, $SF3_1$;

(8N-1)th display line: subfields $SF1_1$ to $SF2_8$; $SF3_1$ to $SF3_6$;

(8N-)th display line: subfields $SF1_1$ to $SF2_8$, $SF3_1$ to $SF3_3$, as indicated by the white circles and overlapping circles of the FIG. 19.

Thus, in the fourth grayscale driving in accordance with the '0001' pixel drive data GD, the discharge cells each emit light at a luminance level corresponding with the period of the light emission generated by the sustained discharge induced in the course of a single field display period, that is, as shown in FIG. 27:

the discharge cells arranged on the (8N-7)th display line are at luminance level '20';

the discharge cells arranged on the (8N-6)th display line are at luminance level '17';

the discharge cells arranged on the (8N-5)th display line are at luminance level '14';

the discharge cells arranged on the (8N-4)th display line are at luminance level '19';

the discharge cells arranged on the (8N-3)th display line are at luminance level '16';

the discharge cells arranged on the (8N-2)th display line are at luminance level '13';

the discharge cells arranged on the (8N-1)th display line are at luminance level '18'; and the discharge cells arranged on the (8N)th display line are at luminance level '15'.

When '0000' pixel drive data GD representing the highest luminance is supplied, a light emission display based on the fifth grayscale driving is implemented as detailed below. Because all the bits of the pixel drive data GD are logic level 0, the erasure discharge is not induced at all during the single field display period. Accordingly, the discharge cells discharge light continuously in the sustain steps I of the subfields $SF1_1$ to $SF1_4$, $SF2_1$ to $SF2_8$, $SF3_1$ to $SF3_8$, and SF4.

Thus, in the fifth grayscale driving in accordance with the '0000' pixel drive data GD, the discharge cells each emit light at a luminance level corresponding with the period of the light emission generated by the sustained discharge induced in the course of a single field display period. Specifically, as shown in FIG. 27, the discharge cells arranged on the respective display lines all emit light at the luminance level '21'.

In the line dither processing of this embodiment, the line dither offset values LD are added to the pixel data PD. Accordingly, when a certain display line is driven with kth grayscale driving (k=1, 2, 3, 4, 5), the adjacent display lines are driven with kth grayscale driving or (k+1)th grayscale driving. As shown in FIG. 27, when upper display lines in a group of adjacent display lines are driven by means of the third grayscale driving, lower display lines are driven by means of the third or fourth grayscale driving, so that the difference in luminance therebetween is '3' or '5'. When upper display lines are driven by means of the second grayscale driving, lower display lines are driven by means of the second or third grayscale driving, so that the luminance difference is then '1', '2', '3', or '5'. Accordingly, with the luminance difference '3' taken as a reference, the bias is no greater than ±'2'. Therefore, a high-quality line dither display in which the luminance difference between all the adjacent display lines of the PDP 100 is substantially uniform can be implemented.

As described above, in the drive shown in FIGS. 18A to 18H, because L (two) address steps W are executed continuously each time one sustain step I is executed, the number of divisions (four) of the subfield (SF1) bearing the low luminance grayscale is smaller than the number of divisions (eight) in the other subfields. Further, the order of execution of the address steps executed in the subfield bearing the low luminance grayscale is the same as in the case of the other subfields.

Therefore, according to this driving, even when the period to be allocated to the subfield bearing the low luminance grayscale is short compared with the other subfields, a high-quality line dither display in which the difference in luminance between all the adjacent display lines of the PDP 100 is substantially uniform can be implemented similarly to the drive shown in FIGS. 6A to 6H.

In this embodiment, in order to set each of the discharge cells to either the lit mode or unlit mode in accordance with the pixel data, so-called selective erasure addressing is adopted, in which all the discharge cells are preset to the lit mode and discharge cells are then selectively made to make the transition to the unlit mode in accordance with pixel data.

However, the present invention can also be applied to a case of adopting so-called selective write addressing, in which all the discharge cells are preset to the unlit mode and discharge cells are selectively made to make the transition to the lit mode in accordance with pixel data.

Figure 28:
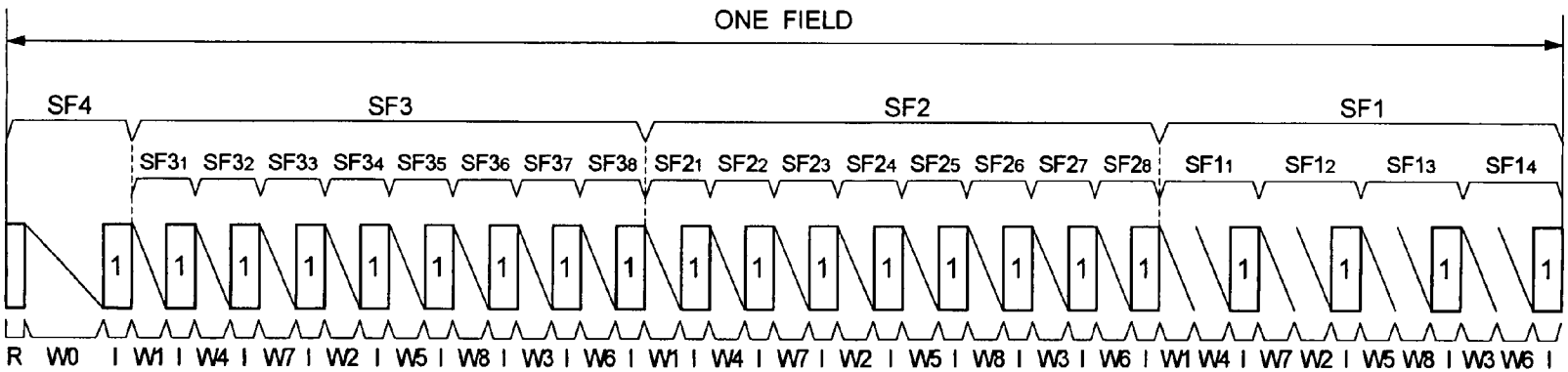
FIG. 28 shows the light emission drive sequence in the first field according to another embodiment of the present invention.

FIG. 28 shows a light emission drive sequence used when implementing the driving in the first field as shown in FIG. 18A by adopting selective write addressing. FIG. 29 shows light emission drive patterns performed on the basis of the light emission drive sequences shown in FIGS. 18E to 18H.

Figure 3:
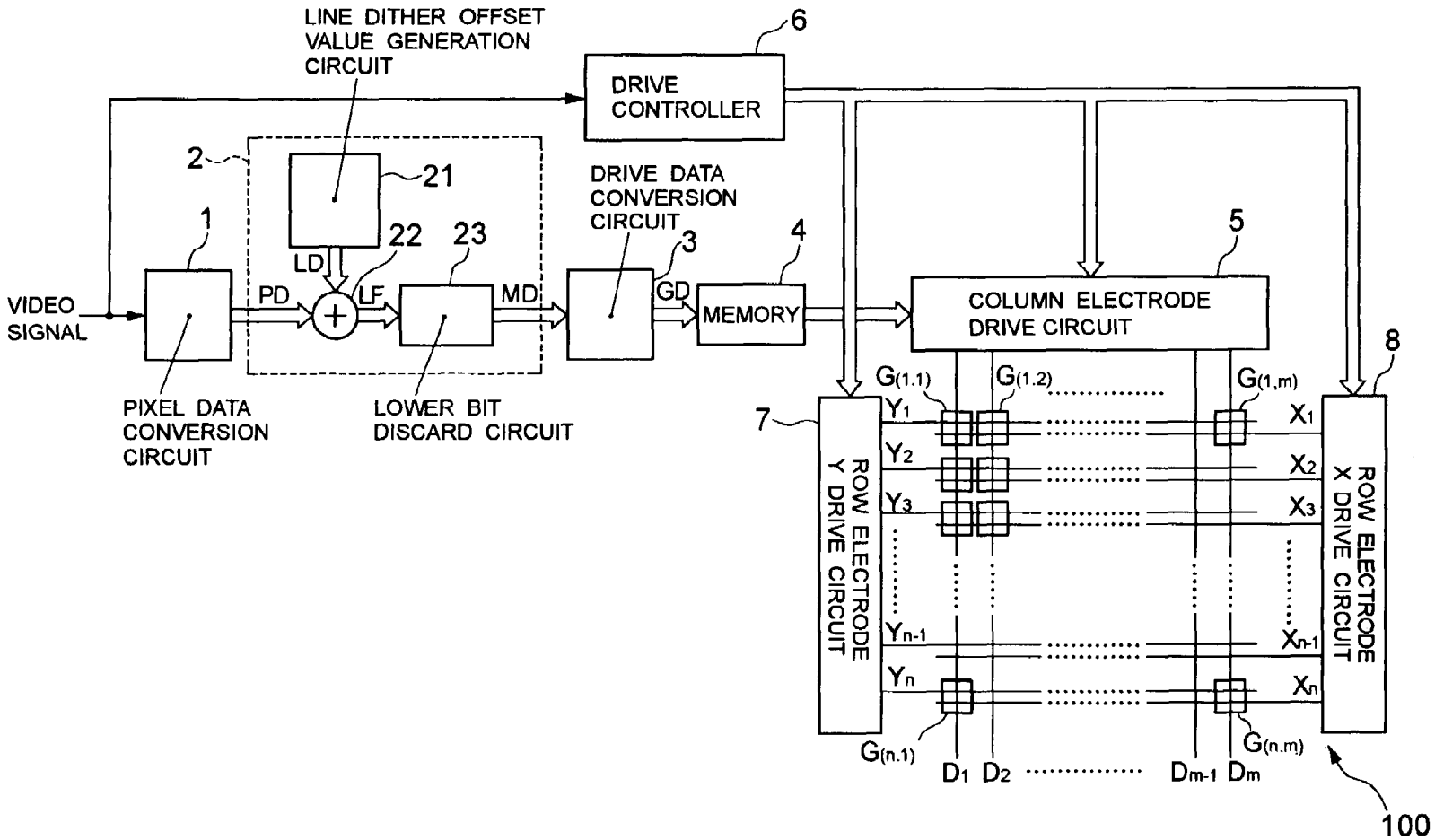
FIG. 3 schematically illustrates the constitution Of a plasma display device that has the driving device according to one embodiment of the present invention.

When selective write addressing is adopted, the drive data conversion circuit 3 shown in FIG. 3 converts multiple grayscale pixel data MD into 4-bit pixel drive data GD in accordance with the data conversion table shown in FIG. 29. The drive control circuit 6 implements light emission drive control on the basis of the light emission drive sequence as shown in FIG. 28 in the initial first field, in accordance with this pixel drive data GD.

In the light emission drive sequence shown in FIG. 28, the reset step R, address step W0 and sustain step I are executed in sequence in the leading subfield SF4. The reset step R shown in FIG. 28 causes all the discharge cells $G_{(1,1)}$ to $G_{(n,m)}$ of the PDP 100 to perform a reset discharge all together and initializes the discharge cells $G_{(1,1)}$ to $G_{(n,m)}$ in the unlit mode (state in which a wall charge does not exist). In the address step W0, the discharge cells G arranged on the first to nth display lines of the PDP 100 are selectively made to perform a write discharge in accordance with the pixel drive data GD as shown in FIG. 29, in sequence one display line at a time, to make the transition to the lit mode (state where a wall charge is formed). Further, the discharge cells in which a write discharge is not induced in this address step W0 retain their state until immediately before this address step W0, that is, the unlit mode. Only those discharge cells set to the lit mode are made to perform discharge light emission continuously over period '1' in the sustain step I.

After the execution of this subfield SF4, the subfields $SF3_1$ to $SF3_8$, $SF2_1$ to $SF2_8$, and $SF1_1$ to $SF1_4$, are executed in sequence. The address steps W1 to W8 are executed as detailed below in the subfields SF3 to SF1.

In the address step W1, only those discharge cells that are arranged on the (8N-7)th display lines, namely the 1st, 9th, 17th, . . . , and (n-7)th display lines, among all the discharge cells $G_{(1,1)}$ to $G_{(n,m)}$ formed in the PDP 100, are selectively caused to perform a write discharge in accordance with the pixel drive data. As a result, the discharge cells in which the write discharge is induced are set to the lit mode, and the discharge cells in which the write discharge is not induced retain the state up until immediately before the address step W1. Thus, the address step W1 sets the discharge cells arranged on the (8N-7)th display lines to either the unlit or lit mode in accordance with the pixel drive data.

In the address step W4, only those discharge cells arranged on the (8N-4)th display lines, namely the 4th, 12th, 20th, . . . , and (n-4)th display lines, are selectively made to perform a write discharge in accordance with the pixel drive data. As a result, the discharge cells in which the write discharge is induced are set to the lit mode, and the discharge cells in which the write discharge is not induced retain the state up until directly before the address step W4. Thus, the address step W4 sets the discharge cells arranged on the (8N-4)th display lines to either the unlit or lit mode in accordance with the pixel drive data.

In the address step W7, only discharge cells arranged on the (8N-1)th display line, namely the 7th, 15th, 23rd, . . . , and (n-1)th display lines, are selectively made to perform a write discharge in accordance with the pixel drive data. As a result, the discharge cells in which the write discharge is induced are set to the lit mode, and the discharge cells in which the write discharge is not induced retain the state up until directly before the address step W7. Thus, the address step W7 sets the discharge cells arranged on the (8N-1)th display lines to either the unlit or lit mode in accordance with the pixel drive data.

In the address step W2, only the discharge cells arranged on the (8N-6)th display lines, namely the 2nd, 10th, 18th, . . . , and (n-6)th display lines, are selectively made to perform the write discharge in accordance with the pixel drive data. As a result, the discharge cells in which the write discharge is induced are set to the lit mode, and the discharge cells in which the write discharge is not induced retain the state up until immediately before the address step W2. Thus, the address step W2 sets the discharge cells arranged on the (8N-6)th display lines to either the unlit or lit mode in accordance with the pixel drive data.

In the address step W5, only the discharge cells arranged on the (8N-3)th display lines, namely the 5th, 13th, 21st, . . . , and (n-3)th display lines, are selectively made to perform the write discharge in accordance with the pixel drive data. As a result, the discharge cells in which the write discharge is induced are set to the lit mode, and the discharge cells in which the write discharge is not induced retain the state up until directly before the address step W5. Thus, the address step W5 sets the discharge cells arranged on the (8N-3)th display lines to either the unlit or lit mode in accordance with the pixel drive data.

In the address step W8, only the discharge cells arranged on the (8N)th display lines, namely the 8th, 16th, 24th, . . . , and nth display lines, are selectively made to perform the write discharge in accordance with the pixel drive data. As a result, the discharge cells in which the write discharge is induced are set to the lit mode, and the discharge cells in which the write discharge is not induced retain the state up until directly before the address step W8. Thus, the address step W8 sets the discharge cells arranged on the (8N)th display lines to either the unlit or lit mode in accordance with the pixel drive data.

In the address step W3, only the discharge cells arranged on the (8N-5)th display lines, namely the 3rd, 11th, 19th, . . . , and (n-5)th display lines, are selectively made to perform the write discharge in accordance with the pixel drive data. As a result, the discharge cells in which the write discharge is induced are set to the lit mode, and the discharge cells in which the erasure discharge is not induced retain the state up until directly before the address step W3. Thus, the address step W3 sets the discharge cells arranged on the (8N-5)th display lines to either the unlit or lit mode in accordance with the pixel drive data.

In the address step W6, only the discharge cells arranged on the (8N-2)th display lines, namely the 6th, 14th, 22nd, . . . , and (n-2)th display lines, are selectively made to perform the write discharge in accordance with the pixel drive data. As a result, the discharge cells in which the write discharge is induced are set to the lit mode, and the discharge cells in which the write discharge is not induced retain the state up until directly before the address step W6. Thus, the address step W6 sets the discharge cells arranged on the (8N-2)th display lines to either the unlit or lit mode in accordance with the pixel drive data.

In the light emission drive sequence shown in FIG. 28, the following steps are executed in the following subfields:

address step W1 in the subfields $SF3_1$ and $SF2_1$;

address step W4 in the subfields $SF3_2$ and $SF2_2$;

address step W7 in the subfields $SF3_3$ and $SF2_3$;

address step W2 in the subfields $SF3_4$ and $SF2_4$;

address step W5 in the subfields $SF3_5$ and $SF2_5$;

address step W8 in the subfields $SF3_6$ and $SF2_6$;

address step W3 in the subfields $SF3_7$ and $SF2_7$;

address step W6 in the subfields $SF3_8$ and $SF2_8$, and the following steps are executed in the following subfields in sequence:

address steps W1 and W4 in the subfield $SF1_1$;

address steps W7 and W2 in the subfield $SF1_2$;

address steps W5 and W8 in the subfield $SF1_3$; and address steps W3 and W6 in the subfield $SF1_4$.

The sustain step I, in which only those discharge cells in the lit mode are made to emit light by performing a sustained discharge continuously over the light emission period '1', is executed directly after the address steps W1 to W8.

Whether or not the write discharge should be induced in the address steps W1 to W8 of the respective subfields SF1 to SF4 is determined by the bits of the pixel drive data GD shown in FIG. 29. Specifically, the occurrence of the write discharge in the subfield SF4 is determined by the 0th bit of the pixel drive data GD, the occurrence of the write discharge in the subfield SF3 is determined by the first bit of the pixel drive data GD, the occurrence of the write discharge in the subfield SF2 is determined by the second bit of the pixel drive data GD, and the occurrence of the write discharge in the subfield SF1 is determined by the third bit of the pixel drive data GD. That is, only when the bits of the pixel drive data GD are logic level 1 is a write discharge induced in the discharge cells in the address step W of the subfields corresponding with these bits and the discharge cells set to the lit mode. In the light emission driving sequence shown in FIG. 28, the opportunity to shift the discharge cells from the lit mode to the unlit mode in the course of a single field display period arises only in the reset step R of the leading subfield SF4. Accordingly, as shown in FIG. 29, the initial write discharge (indicated by overlapping circles) is induced in the discharge cells within the single field display period, and, once set to the lit mode, the state is retained until the final subfield $SF1_4$ and a sustained discharge (indicated by a white circle) is executed continuously in the sustain steps I that exist in this interval.

Although, in the driving shown in FIGS. 18A to 18H and in FIG. 28, an example of when the subfield SF1 is divided into four lower subfields $SF1_1$ to $SF1_4$ is shown, the number of divisions of the subfield SF1 is not limited to four.

Figure 30A:
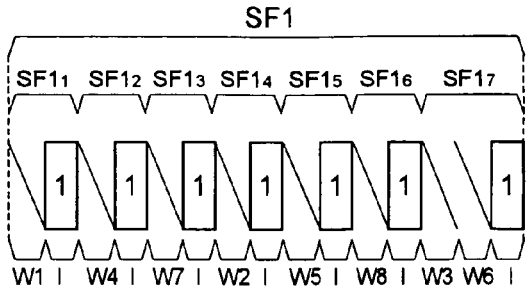
FIGS. 30A to 30E show various examples of division of a certain subfield, respectively.
Figure 30B:
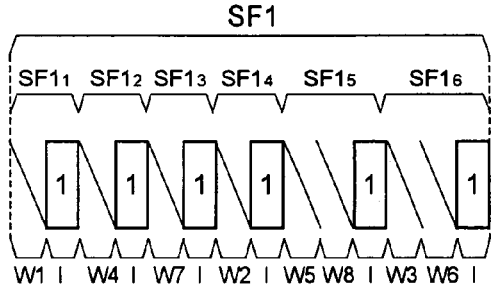
Figure 30C:
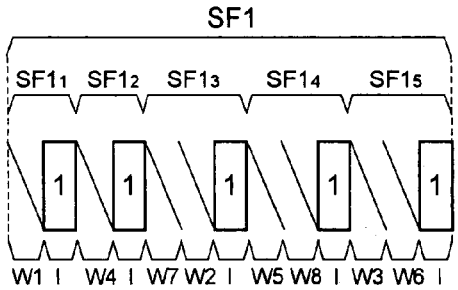
Figure 30D:
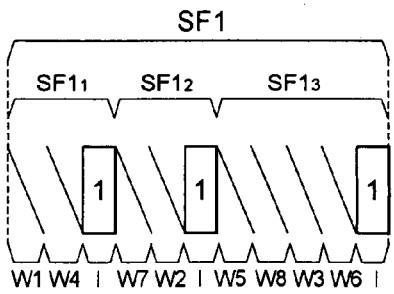
Figure 30E:
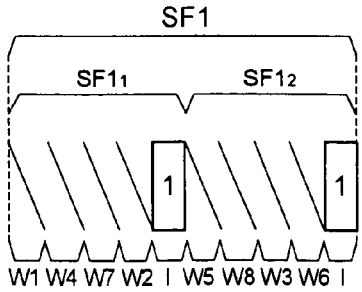

For example, the subfield SF1 may be divided:

into seven as shown in FIG. 30A;

into six as shown in FIG. 30B;

into five as shown in FIG. 30C;

into three as shown in FIG. 30D; and into two as shown in FIG. 30E.

This application is based on a Japanese patent application No. 2003-190284 filed on Jul. 2, 2003, and the entire disclosure thereof is incorporated herein by reference.

What is claimed is:

1. A method of grayscale-driving a display panel in accordance with pixel data derived from a video signal, the display panel including a plurality of display lines, with a plurality of pixel cells serving as pixels being arranged on each of the plurality of display lines, a display period of a single field of the video signal being divided into a plurality of subfields, the method comprising:

dividing one of the plurality of subfields into M lower subfields (M is an integer greater than one);

making M groups of display lines by sequentially taking every M display lines from the plurality of display lines of the display panel;

performing first to Mth address steps in the M lower subfields respectively and sequentially, each said address step setting the pixel cells belonging to the display lines of the display line group concerned, to a drive mode determined by the pixel data;

performing a first light emission step to cause the pixel cells whose drive mode is a lit mode, to emit light directly before or after the address step concerned;

dividing another one of the plurality of subfields into N lower subfields (N is smaller than M);

making N groups of address steps from the first to Mth address steps, each said address step group including one or more address steps, at least one of said N address step groups including a plurality of address steps;

performing the N address step groups in the N lower subfields respectively and sequentially; and performing a second light emission step to cause the pixel cells whose drive mode is the lit mode, to emit light directly before or after the address step group concerned.

2. The display panel driving method according to claim 1, wherein the order of execution of the first to Mth address steps in the N lower subfields is the same as the order of execution of the first to Mth address steps in the M lower subfields.

3. The display panel driving method according to claim 1, wherein a reset step, which initializes all of the pixel cells in the lit mode, is executed in a leading subfield among the plurality of subfields.

4. The display panel driving method according to claim 1, wherein the display panel is a plasma display panel, and only the pixel cells in the lit mode are repeatedly made to perform a sustained discharge in each of the first and second light emission steps.

* * * * *